United States Patent [19]

Kimura et al.

[11] 4,056,123

[45] Nov. 1, 1977

[54] HYDRAULIC OSCILLATOR

[75] Inventors: Tsuneo Kimura, Kusatsu; Shiro Takeshika, Ikeda, both of Japan

[73] Assignee: Nihon Spindle Seizo Kabushiki Kaisha, Japan

[21] Appl. No.: 509,184

[22] Filed: Sept. 25, 1974

[30] Foreign Application Priority Data

Sept. 26, 1973 Japan ..... 48-108194
Nov. 12, 1973 Japan ..... 48-127082

[51] Int. Cl.[2] ..... F01L 31/00; F01L 25/04
[52] U.S. Cl. ..... 137/624.14; 91/330
[58] Field of Search ..... 91/330, 318; 137/624.14

[56] References Cited

U.S. PATENT DOCUMENTS

| | | | |
|---|---|---|---|
| 3,145,796 | 8/1964 | Padula | 91/318 |
| 3,385,166 | 5/1968 | Kroffke | 91/318 |
| 3,570,523 | 3/1971 | Pauliukonis | 137/624.14 |
| 3,786,723 | 1/1974 | Fruehauf | 91/330 |
| 3,790,125 | 2/1974 | Swatty | 91/318 |

*Primary Examiner*—Paul E. Maslousky
*Attorney, Agent, or Firm*—Blum, Moscovitz, Friedman & Kaplan

[57] ABSTRACT

In a hydraulic oscillator having a main body equipped with inflow and outflow ports wherein a vibratory member is actuated to cause self-excited vibration by pressurized oil passing from the inflow port inside an oil pressure chamber so as to generate alternating flow of oil under pressure at the outflow ports, said hydraulic oscillator characterized by resilient devices provided proximate both ends of the stroke of the vibratory member so as to regulate the displacement thereof.

5 Claims, 20 Drawing Figures

HYDRAULIC OSCILLATOR

BACKGROUND OF THE INVENTION

This invention pertains to a hydraulic oscillator wherein a vibratory member is brought into self-excited vibration inside an oil pressure chamber by means of oil pressure so as to generate alternating flow at oil pressure outlets by vibration thereof, said oscillator being effectively used as driving means for appropriate types of mechanisms and machinery.

Machines which function by oscillation or reciprocation, such as a pile drivers, perform the function by transmitting impulses from, for instance, a vertical reciprocating device to piles or the like. Such machines are never free from serious problems with respect to environmental destruction on account of their noise and vibration.

Customary machines which involve vibration, such as a pile driver, generally utilize the driving force of vibration by way of a rotating eccentric load driven by an electric motor. Because of the tremendous load imposed on bearings and the like, however, these machines can operate at rates of only about 20 CPS but not higher; in addition, it is extremely difficult to change the frequency and/or the impact of vibration during the operation.

In order to overcome such problems, there have been proposed several methods; and in one case, an eccentric load which permits the change of vibration during the operation is rotated by an oil pressure motor or the like so as to obtain the driving force of vibration. In another case, an eccentric load is reciprocated by the use of an electro-hydraulic servo valve, etc., in a cylinder. However, it is very difficult to obtain a more forceful vibration in the former case, while in the latter case the frequency characteristics become extremely inferior as the apparatus becomes larger in volume; also the increase in size makes the apparatus more expensive to fabricate and more complex in design, although the latter does permit a higher frequency.

In the past few years there has been a proposal for the solution of these problems in which a hydraulic oscillator is used which employs positively self-excited vibration of oil pressure known as a dynamic characteristic of oil pressure valves.

As an example of said hydraulic oscillator, there has been proposed a spool valve type self-excited oscillator. In this type of the oscillator, however, slight displacement of a spool in one direction is multiplied by transient axial force, and the spool stops its excursion at a position where the displacement balances with the force of inertia, viscous resistance and the restoration force of fluid, and thereafter the spool is moved in the opposite direction by the force of restoration of fluid. In this manner, the spool repeats the sequence of movement and continues to vibrate or reciprocate. However, the point at which the spool stops is not constant, but varies in accordance with the accuracy of component parts, temperature of oil, flow volume, etc., continuously. When the transient axial force is increased so as to improve the oscillation characteristics, the displacement increases correspondingly, and vibration becomes smaller in consequence until at last the vibration stops at the end of a stroke.

When the force of restoration of fluid is increased so as to increase the vibration, on the other hand, the oscillation characteristics becomes inferior, and the spool stops its vibration at a neutral position. It has been found that selection as well as maintenance of optimum operating conditions are almost impossible due to various factors such as force of inertia, viscous resistance and so forth.

SUMMARY OF THE INVENTION

The primary object of the present invention is therefore the provision of a new and unique hydraulic oscillator, i.e., reciprocator, which eliminates all of the aforementioned problems of customary oscillators and ensures a high and stable vibration by providing an elastic device at the ends of the stroke of a vibratory member which is brought into self-excited vibration by oil pressure.

It is another object of the present invention to provide a spool type hydraulic oscillator having a remarkably improved oscillating function and durability by lessening a damping resistance and increasing the force of restoration of fluid exerted on the spool as a slidable member by oil fluid as well as by the transient axial force.

It is a further object of the present invention to provide a hydraulic oscillator having the above-described features which is easy to fabricate and inexpensive to produce and in which vibration is assured at all times without stopping even when subjected to overload, and in which vibration characteristics can easily be regulated.

It is still another object of the present invention to provide a hydraulic oscillator of the above-described type, the vibration of which can be regulated as desired by a remote control device during operation and which has a markedly improved vibration characteristic.

It is still another object of the present invention to provide a hydraulic oscillator of the above-described type in which the problem of transfer of the effects of vibration to the environment is decreased as much as possible, and in which alternating vibration generated thereby is imparted to a cylinder having a vibration load so that vibration of a high frequency may be applied to a device such as a pile driver, thereby assuring an appreciably improved workability and a remarkably facilitated maintenance of the apparatus.

It is still another object of the present invention to provide a hydraulic oscillator of the above-described type which is compact but is capable of imparting a larger output of vibration to machines together with stabilized vibration, and in which the automatic regulation device thereof can also be configured in an easier and simpler device having a greater durability and easier operation.

It is yet another object of the present invention to provide a hydraulic oscillator of the above-described type which generates stable alternating flow irrespective of the weight of the load of the object matter to be driven.

It is yet another object of the present invention to provide a hydraulic oscillator of the above-described type wherein inflow of pressure oil is regulated in an oil pressure self-excited valve to regulate the frequency of alternating of the output flow, and in addition, displacement of the vibratory member may be changed so as to change the period of the vibration member thereby regulating the vibration of the output alternating flow, and at the same time, the output flow rate is changed by external signal pressure oil so as to thereby generate alternating flow stably irrespective of the weight of the load and to facilitate the feed-back from the object matter to be driven.

It is yet another object of the present invention to provide a hydraulic oscillator having all the aforementioned features in which the vibration and flow ratio on the output alternating flow can be chaned effectively and continuously even when the pressure and flow volume of the pressure oil fed into the oscillator are kept constant, whereby the regulation thereof can be made in an extremely easy manner.

The above-mentioned hydraulic oscillator in accordance with the present invention is characterized by a vibratory member which is brought to self-excited vibration inside an oil pressure chamber by pressurized oil from the inflow port of the oscillator having both inflow port and outlet ports, vibration of said vibratory member causing alternating flow at the outlet ports, and also by elastic devices disposed in proximity to the ends of the stroke of said vibratory member, said elastic device limiting the amplitude of said vibratory member and imparting to said vibratory member the initial acceleration in reverse direction.

Still other objects and advantages of the invention will in part be obvious and will in part be apparent from the specification.

The invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1-A is also a transverse cross section showing the embodiment of FIG. 1 in which the spool is displaced to the left;

FIG. 1-B is also a transverse cross-section showing the embodiment of FIG. 1 in which the spool makes contact with stop;

FIG. 5-A is a transverse cross-section showing another embodiment of the present invention;

DESCRIPTION OF THE PREFERRED EMBODIMENTS

Figure 1:
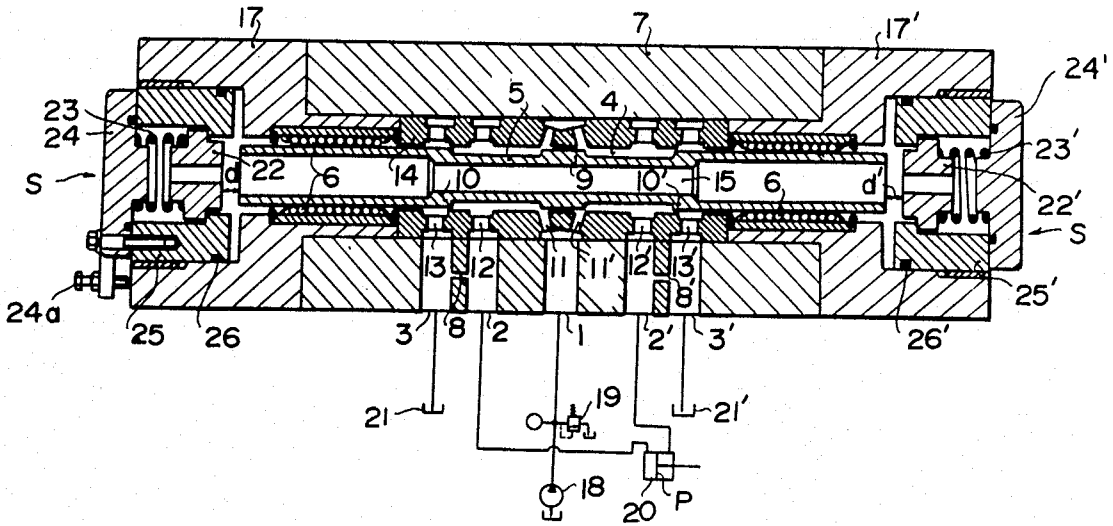
FIG. 1 is a transverse cross section showing an embodiment of the present invention, a spool being the vibratory member.

The present invention relates to a hydraulic oscillator in which a vibratory member is actuated by oil pressure to cause self-excited vibration.

One of the essential requirements for realizing all the aforementioned features of this invention is the provision of elastic or resilient devices at both ends of the stroke of the vibratory member. These function to limit the amplitude of oscillation of the vibratory member and also impart to it the initial acceleration in the opposite direction.

The hydraulic oscillator in accordance with the present invention features a spool which is used as a vibratory member so as to cause self-excited vibration. The main body of the oscillator is equipped with an inflow port to feed oil under pressure to an oil pressure chamber as well as to pairs of outflow ports and of oil exhaust ports; each one of said two pairs of ports is disposed in pressure communication with an oil pressure chamber symmetrically located in predetermined spacing therebetween, with the inflow port as the center. The spool is supported by bearings slidably within the oil chamber in the axial direction. The spool has a land of a predetermined width which is disposed at a position opposed to the inflow port in a minus-lap relation thereto and also has a pair of spool lands of a predetermined width which are disposed respectively at positions opposed to said pair of oil exhaust ports so as to open and close said oil exhaust ports alternatively. The term minus-lap indicates that the width of the land in question is less than the width of the inflow port so that the land cannot close said port completely.

The present invention further features essentially in that, in the hydraulic oscillator of the above-described types, the opening of the inflow port is defined into a single annular groove which surrounds the center land of the spool with a predetermined spacing and is tapered inwardly with predetermined angles.

The hydraulic oscillator of this invention is further characterized by a pilot spool built in the oil pressure self-excited vibration by oil pressure, and also by resilient devices provided in the proximity of both the end sections of the stroke of the spool so as to limit the amplitude thereof and to impart the initial acceleration oil pressure at the outflow ports, wherein the opening of the inflow port is defined into a single annular groove which surrounds the center land of the spool with a predetermined spacing and is tapered inwardly with predetermined angles.

The hydraulic oscillator of the present invention consists essentially of a pilot spool which is actuated to cause self-vibration by oil pressure from the inflow port, a pilot valve incorporating therein said pilot spool and generating alternate oil pressure at the outflow ports by vibration of said pilot spool, a main valve incorporating therein a main spool which is changed over by said alternate oil pressure so generated, and elastic devices provided at both the end sections of the stroke of each of said two spools, the position of at least one pair of said resilient devices being capable of adjustment.

Likewise the hydraulic oscillator of this invention comprises a pilot spool which is actuated into self-vibration by pressurized oil from the inflow port, a pilot valve incorporating therein said pilot spool and generating alternate oil pressure at the outflow ports by vibration of said pilot spool, a main valve incorporating a main spool which is changed over by said alternate oil pressure so generated, and elastic devices provided in the proximity of both the end sections of stroke of each of said two spools, wherein a pilot circuit connecting the outflow ports of the pilot valve with the oil pressure chamber for actuation of the main spool is connected to a feed-back circuit from the object machine to be driven by the so-generated vibration via a throttle.

The hydraulic oscillator in accordance with the present invention further comprises a vibratory member which is actuated to cause self-excited vibration in the oil chamber by pressurized oil from the inflow port, resilient devices provided in the proximity of both the end sections of the stroke of the vibratory member so as to limit the amplitude thereof and generate alternating oil pressure at the outflow port, and regulating members provided respectively to said resilient devices so as to regulate the positioning of said resilient devices thereby making it possible to change the frequency of the alternating oil pressure and distribution thereof to the right and left.

In accordance with the hydraulic oscillator of the present invention, it is now possible to minimize adverse effects exerted to the hydraulic oscillator by change in viscosity due to the kinds of oil used, the temperature of oil, etc. to regulate the amplitude of the spool and to impart thereto the force of mechanical restoration thereby facilitating to enhance and obtain a desired frequency and ensuring accurate and stable vibration to lead to extreme advantages in practice.

According to the present invention further, damping resistance can be lessened to a marked extent, and damping length can easily be prolonged as well, and hence, stability can readily be increased to assure an easy oscillation. Further, pressure is well balanced so that eccentric load is not imparted to the bearings in the axial directions, and the load is also extremely small to meet the requirements for use at a high pressure. Accordingly, the life is prolonged markedly, and flow of the oil is always generated at the stroke ends without causing any hindrance for the oscillating functions such as stoppage of oscillation so as to ensure smooth operation. Regulation of pressure, mass and an escape valve whenever required, renders an easy control of a desired frequency so that any hydraulic oscillator of self-excited vibration type to obtain alternate oil pressure can be designed in a simplified construction to meet with a wider variety of applications with improved efficiency and advantages.

It is still another feature of the hydraulic oscillator of the present invention that the problem of vibration transfer to the environment during operation is decreased as much as possible, wherein alternate oil pressure generated by the oscillator functioning to cause self-excited vibration is applied to a cylinder having a vibration load so as to vibrate it at a high frequency and to provide accurate and efficient vibration works such as piling with improved workability and enhanced ease for maintenance and control.

It is still further a feature of the hydraulic oscillator of the present invention that the production cost as well as the operation cost are decreased appreciably since the oscillator does not require other oscillating sources such as an electric-hydraulic servo valve. In addition to its capacity to change the frequency simply during operation and also its excellent frequency characteristics, the oscillator can easily be remote-controlled, is easy to operate and ensures effective works as an optimum vibration source.

When the hydraulic oscillator of this invention is used as a vibration work machine, cumulative deviation of vibration load at the vibration imparting section is fed back to the vibratory member of the oscillator so as to change the distribution of stroke to the right and left in a period of the vibratory member, thereby changing the rate of feeding the oil volume to the forward and rear faces of the piston of the above-mentioned vibration imparting section to compensate for the cumulative deviation of the vibration load. In comparison with the customary method of venting the pressure oil to a tank, therefore, the oscillator of this invention marks noticable improvement in efficiency to ensure highly effective works whereby there is no drastic lowering of the actuation force of vibration at the time of compensation of cumulative deviation.

Furthermore, there are provided the oil exhaust ports at the vibration imparting section which are opened by the deviation caused at the start of the vibration load of the vibration imparting section. Provision of said exhaust oil ports ensures an automatic restoration of the vibration load to the middle of stroke, said vibration load being deviated to either side of strokes at the stoppage of operation. Accordingly, initiation of vibration becomes extremely easy, and there is no necessity to provide the oscillator with a constant escape valve to lead to further improvement in the efficiency of the oscillator. By these arrangements, further, danger of electric shock during the operation is eliminated thereby furthering the safety of operation as well as lessening the vibration in good frequency characteristics.

In the hydraulic oscillator of the present invention, the opening of the oil inflow port is formed in such a fashion as to surround the center land of the spool with a predetermined spacing and is defined also by a single annular groove which opens inwardly at a divergent angle so as to enlarge the opening area of the inflow port. It is therefore possible to produce a larger output with a smaller oscillation valve, and the range of acceleration by transient flow is also widened. For this reason, not only the speed of the valve is increased to increase the frequency, but also fabrication of the inflow port becomes easier with higher accuracy thereby affording easier fabrication of the oscillator per se eventually.

As noted previously, the present invention employs a hydraulic oscillator comprising a pilot valve which is actuated to cause self-excited vibration by pressurized oil and a main valve which is changed over by said pilot valve. In this type of the oscillator, regulation of frequency is made, apart from the regulation of the inflow volume of the pressure oil, by way of changing the displacement of the spool, wherein the flow rate is changed either by changing the displacement of the spool or by changing the speed of reciprocating motion of the spool; hence, the flow rate can be regulated by oil pressure signal devices so that frequency as well as distribution to the right and left of the resulting alternating oil pressure can be changed as desired. The above-mentioned arrangement results further in that stable alternating oil pressure can be obtained irrespective of the weight of the load of the matter to be driven; in other words, the load of the matter to be driven exerts no direct influence over the pilot valve. At the same time, feed-back from the device to be driven can be made through the resilient devices, and driving and regulation of the oscillator become more effective when a throttle valve is provided in the pilot circuit connecting the outflow port of the pilot valve with the oil chamber of the main valve for actuation of the spool so as to connect the pilot circuit with the feed-back circuit.

According to the present invention, quick response can be obtained by employing a feed-back circuit which makes it possible to directly change the feed volume of the pressurized oil into the oil pressure chamber for actuation of the main spool. Alternatively, a throttle valve may also be used to effect such a feed-back regulation. In this instance, when the outflow ports of the pilot valve have interposed a throttle valve, desired conditions can be set up to regulate the frequency in an easy manner, even if the pilot valve is connected to the same oil pressure source as that of the main valve. Furthermore, connection of the outflow ports of the main valve with the oil pressure chamber for actuation of the main spool via a throttle valve will cause stable vibration of the main spool.

In the hydraulic oscillator of the present invention, further, the resilient devices regulate the displacement of the self-oscillating valve to thereby regulate the frequency and the flow rate continuously, positioning of said resilient devices being adjustable. It therefore becomes possible, in accordance with this invention, to change the frequency as well as the flow rate of the alternating oil pressure efficiently and effectively while keeping constant the pressure or the volume of the pressurized oil from the inflow port of the oscillator. In this way, not only control of the alternating oil pressure can be made very easily, but also the response characteristics of the oscillator can be improved irrespective of the weight of the load at the side of the machine to be drive by the so-generated alternating oil pressure. Thus, the oscillator of this invention can be used for a wider variety of applications more economically and advantageously.

Further objects and advantages of this invention and the manner in which it is carried out into practice are made apparent in the following description wherein reference is made to the accompanying drawing illustrating preferred forms of the invention.

In FIGS. 1, 1-A and 1-B, there is defined a spool 5 fitting hole 4 which functions as an oil pressure chamber inside the main body 7 of the oscillator having the pressurized oil inflow passage 1, outflow passages 2, 2' and oil exhaust passages 3, 3'. To hole 4 is fitted a spool 5 as a slidable vibratory member which is brought into excited oscillation by oil pressure, said spool 5 being supported by bearings 6 for sliding in the axial direction.

The spool is maintained in a predetermined spacing away from the wall of the fitting hole 4 so as not to make contact therewith. In pressure communication, the hole 4 is connected to the inflow passage 1 which distributes pressurized oil alternately to the right and left. The hole 4 is further connected, in pressure communication, with a pair of inflow ports 11 and 11' which diverge inwardly so that the pressurized fluid enters pockets 4*a* and 4'*a* alternately and impinges against walls 10*a* and 10'*a* of spool 5 to exert pressure alternately on said walls, driving said spool 5 alternately to the left and to the right. Leading out from hole 4 are a pair of outflow ports 12, 12' connected respectively to the outflow passages 2, 2', and a pair of oil exhaust ports 13, 13' connected respectively to the oil exhaust passages 3, 3', both pairs of said ports 12–12' and 13–13' being disposed symmetrically with respect to each other in predetermined spacing with the inflow passage 1 as their center.

The outflow passages 2, 2' may be connected either to the oil exhaust passages 3, 3' via throttle passages 8, 8', or to an oil tank through a branch circuit via a throttle valve or the like.

Oscillation of the spool is self-excited since land 9 cannot simultaneously cover both inflow ports simultaneously, so that the slightest deviation of the spool from dead center in a first direction will result in greater flow of fluid to the other side, termed the second side, and in motion of said spool under the force exerted by the fluid in the second direction. The spool will collide with the resilient end device S and be reversed by said stop and by the force of the fluid now flowing toward the opposite, i.e., the first side. The change in flow direction of the fluid is caused by land 9 covering inflow ports 11 and 11' alternately.

The aformentioned spool 5 has a spool land 9 of a predetermined width provided at a position opposed to form a minus-lap thereon, and a pair of spool lands 10, 10' of a predetermined width provided respectively at positions opposed the symmetrical oil exhaust ports 13, 13' to open or close the oil exhaust ports 13, 13', alternately.

The spool 5 is of a cylindrical shape having a hollow section so as to minimize the mass thereof, and the fitting hole 4 which accepts the spool 5 is hollowed out in the shape of a bushing 14 in order to facilitate the fabrication of the outflow ports. The numerals 17, 17' designate covers of the main body, and the hydraulic pump 18 (FIG. 1) acts as the oil pressure source which is connected to the oil pressure inflow passage 1 via regulating valve 19. The numeral 20 indicates a cylinder which is the prime mover of a vibration imparting device which is connected to the outflow passages 2, 2', and imparts the energizing vibration to the vibration device by means of the alternating oil pressure.

The oil tanks 21, 21' are connected to the oil exhaust passages 3, 3'. The letter S stands for resilient devices. Into the ends of the main body covers 17, 17' there are screwed cartridge main bodies 25, 25' having seals 26, 26' and built-in stoppers 22, 22'. These stoppers 22, 22' with cylindrical axial holes therein are supported by sealed plugs 24, 24' having springs 23, 23' therebetween. When rotated, the cartridge main bodies 25, 25' can move in the axial directions. After spacings *d*, *d'* between the end surfaces of the spool 5 and the stoppers 22, 22' are adjusted to a predetermined value, the rotation of the cartridge main bodies 25, 25' can be fixed by means of fixing screw 24*a*.

Figure 1A:
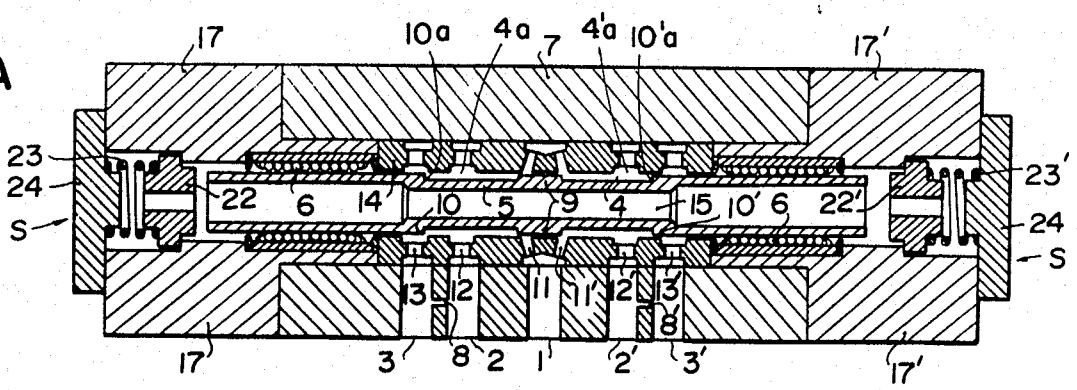
Figure 1B:
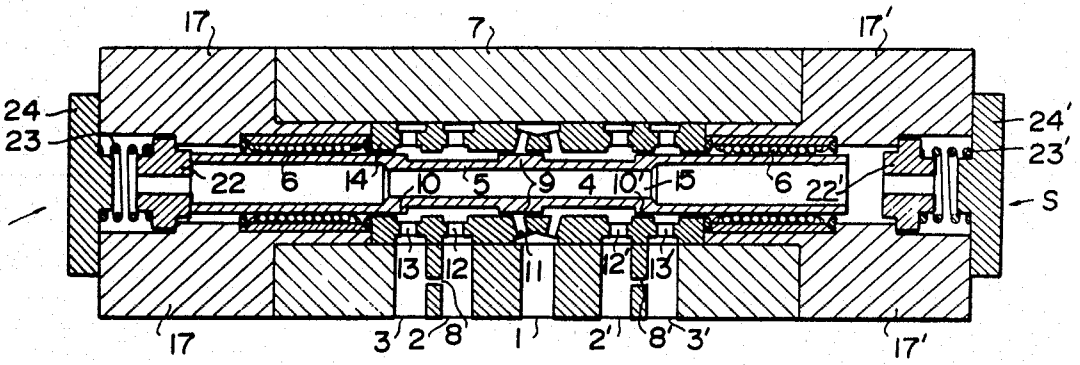

As shown in FIG. 1-A, when the spool 5 is initially displaced slightly to the left of dead center position, the pressurized oil flowing from the inflow passage 1 passes into pocket 4'a of the fitting hole 4 on the right side via the inflow port 11' on the right side, and reaches the right-hand chamber of cylinder 20 (FIG. 2) via the outflow port 2' (FIG. 1) on the right side. The oil discharged from the left-hand chamber of cylinder 20 passes into fitting hole 4 of the left side through passage 2, and thence to tank 21 through the oil exhaust passage 3. At this time, the spool 5 moves leftwards by the action of transient axial force, and makes contact with the stopper 22 as shown in FIG. 1-B. The spool 5 compresses the spring 23 and is finally brought to rest. During the deceleration period the spool 5 is also acted on by the force of fluid restoration on wall 10'a (FIG. 1A), and comes to rest at a certain position. Thereafter the spool 5 is accelerated in the opposite direction by the compressed spring 23 as well as by the force of fluid restoration on wall 10a.

When the spool 5 moves rightwards past through the neutral position, the pressurized oil starts flowing through the inflow port 11 on the left side and a similar sequence results, spool 5 impacting stopper 22' on the right side, and being stopped and then repelled leftwards; the same sequence of movements is repeated to thereby ensure accurate and continued vibration.

In the above-described manner, the stoppers 22, 22' limit the amplitude of excursion of the spool 5 and impart mechanical force of restoration to the spool to produce accurate vibration at a required frequency. In consequence, it becomes very easy to obtain stable high frequency, and oscillation to minimize the influence of oil viscosity which varies with the kind of oil used and its temperature.

Further, the spacings *d, d'* between the spool 5 and the stoppers 22, 22' can be varied to desired values by changing the position of the cartridge main bodies 25, 25', thereby changing the volume of oil flowing out from the outflow ports 2, 2' to change the mode of oscillation. For instance, when the spacing *d* is adjusted to be larger than *d'*, the retention time of the spool 5 is longer in the left side than the right side, and the volume of oil flowing out from the outflow port 2' is larger than from the outflow port 2.

Figure 2:
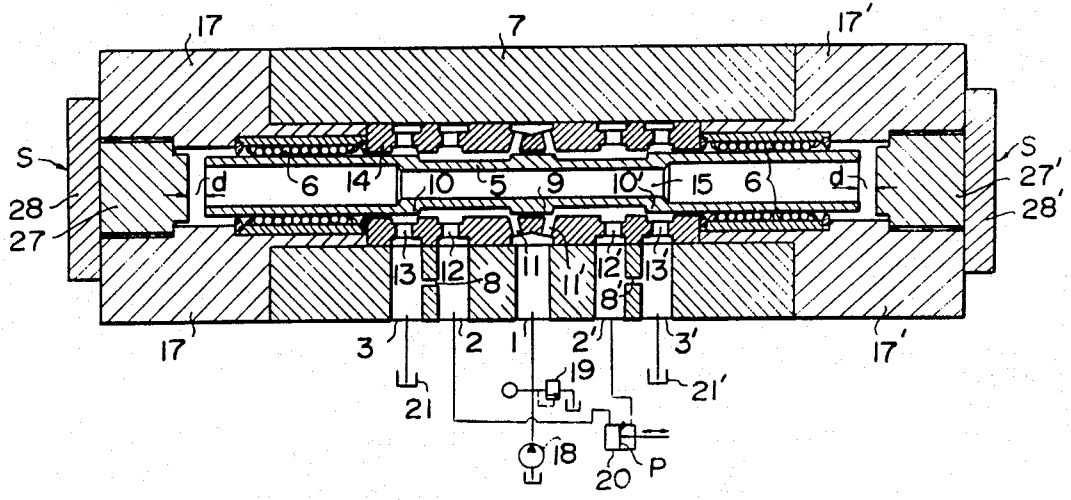
FIG. 2 is a transverse cross section showing another embodiment of the present invention in which another type of an elastic device is used.

FIG. 2 illustrates another embodiment of the oil pressure oscillator of this invention wherein resilient devices 27, 27' made of a metallic or non-metallic material, are built-in in the main body covers 17, 17' by support plates 28, 28'. When the spool 5 moves to the right or left and butts to the resilient devices 27, 27' in the like manner as in the first embodiment, repulsion imparts to the spool a force to the opposite direction to assure vibration with stable frequency.

Figure 3:
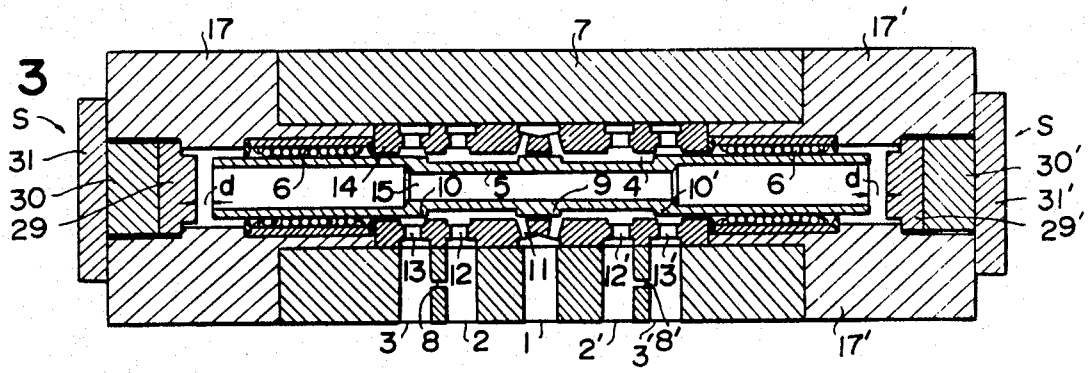
FIG. 3 is a transverse cross section showing a further embodiment of the present invention in which an elastic member having a stop plate is used.

FIG. 3 illustrates still another embodiment wherein the numerals 29, 29' designate butting plates made of a metallic or nonmetallic material which are adapted to the resilient devices 30, 30' by supporting plates 31, 31'. As the butting plates 29, 29' are made of a metal or a non-metallic material of rigid property, they enhance resistance against abrasion and shock, and also prevent damage to as well as prolong the life of the resilient devices 30, 30'.

Figure 4:
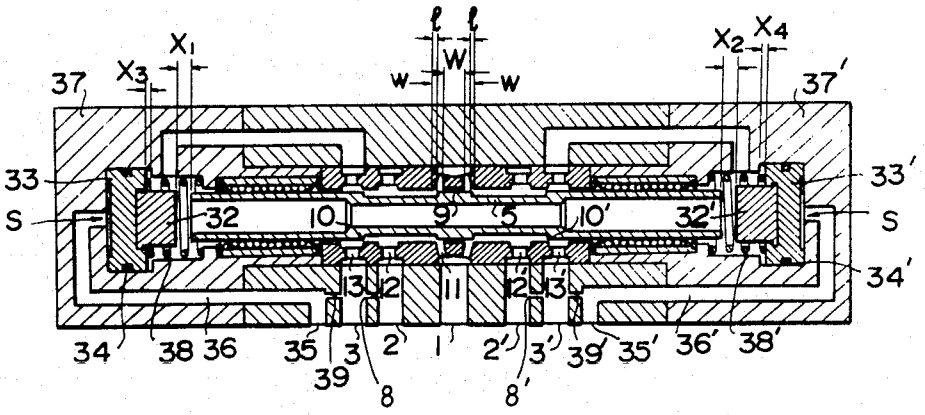
FIGS. 4 and 5 are transverse cross sections showing another embodiment of the present invention in which elastic devices having variable construction of position are used.

FIG. 4 illustrates still another embodiment wherein the resilient devices 32, 32' are integrated with pistons 33, 33', said piston 33, 33' having seals 34, 34', being fitted into the main body cover 37, 37' so as to be slidable in a predetermined distance $X_3$, $X_4$, and being urged outwardly by springs 38, 38'. The numerals 35, 35' are oil pressure inflow ports to apply the oil pressure to the pistons 33, 33' from the outside which are connected to the rear of the pistons 33, 33' via the inflow passages 36, 36' and regulate the positionings of them. The inflow ports 35, 35' are connected to the oil exhaust passages 3, 3' through the throttle passages 39, 39', and the oil pressure fed therethrough reaches tank pressure within a predetermined period of time. On account of the oil pressure thus charged, the pistons 33, 33', which are to limit slightly the stroke of the spool 5 by their inward movements respectively in distances of $X_3$ and $X_4$, return to their normal positions within a predetermined period of time.

The spool 5 impacts the resilient devices 32, 32' near the end portions of its stroke, rebounds and performs a stable vibration. In this instance, when the center of the stroke of the cylinder 20 (FIG. 1) for example, of the piston P which is actuated by the alternating flow from the outlet of the oscillator, is somehow deviated, the pressure oil is fed into either of the inflow ports 35, 35' in a predetermined period of time and actuates the pistons 33, 33' whereupon feed-back control becomes feasible to ensure efficient and stable operation.

Alternatively, movement of the resilient devices 32, 32' can be made, instead of by hydraulic means, by way of mechanical means such as, for example, a linking mechanism which interlocks with the deviation of the stroke center of the above-mentioned piston P.

In designing the spool 5 as exemplified in FIG. 4, the following inequalities should be noted:

$$X_1 \text{ or } X_2 < (W + w - l) \text{ or}$$

$$(X_1 - X_3) \text{ or } (X_2 - X_4) > l$$

where $X_1$ and $X_2$ are the distances between the left hand and right hand ends of spool 5 and resilient devices 32 and 32'; $X_3$ and $X_4$ are the distances through which pistons 33 and 33' may move;

*l* is the length of the minus-lap of the spool 5;

*W* is the width of the land of the sleeve; and

*w* is the width of the inflow ports 11, 11'.

Figure 5:
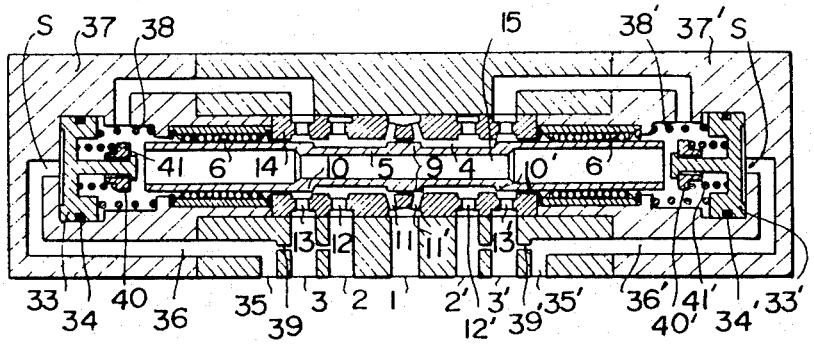
Figure 5A:
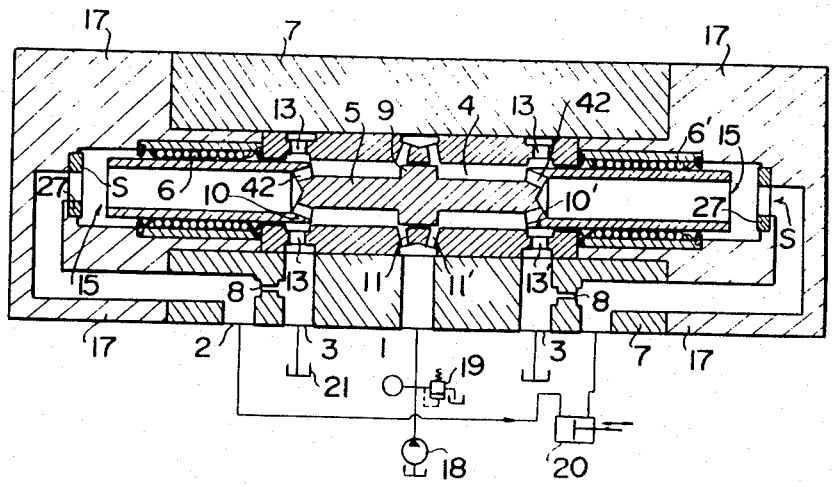

In the embodiment shown in FIG. 5, pistons 33, 33' incorporate spring holders 40, 40' together with springs 41, 41' so that the spring constant can readily be changed by replacing the springs 41, 41'.

In each of the above-described embodiments, the resilient devices are mounted on the main body cover. It will be apparent, in this connection, to one of ordinary skill in the art that the same effect can be obtained even when the resilient devices are mounted on the ends of the spool 5.

In the embodiment of FIG. 5-A, the length of the spool 5 is increased so as to prolong the length of damping whereby the distance between the inflow port 11 and the outflow port 12 is also lengthened while the distance between the outflow port 12 and the oil exhaust port 13 is shortened for that purpose. In this case, the spool 5 is supported by the axial bearing 6, keeping always a required spacing between it and the main body 7 of the oscillator. The spool 5 has also a minus-lap land 9 which is opposed to the inflow ports 11, 11' having desired angles respectively. The spool 5 is further provided with cylinder ports 42 and tank ports so as to increase the length of the damping.

For these reasons, when the spool 5 is located at the neutral position in the main body 7 of the oscillator, the width of the land 9 of the spool 5 is narrower than the distance between the inflow ports 11, 11' which diverge inwardly, and the lands 10, 10' overlap the oil exhaust ports 13, 13' as desired. Since the spool 5 does not touch directly anything other than the above-mentioned bearings 6, 6', the pressure oil fed through the pressure oil inflow passage 1 flows into the spacing between the spool fitting hole 4 and the spool 5. Accordingly, when the spool 5 displaces, for instance, to the left slightly, a transient axial force is imparted to the spool 5 due to transient flow caused by opening and closing, and increases further the displacement of the spool 5 to the left.

On the other hand, the force of restoration by the incoming pressurized oil and the returning pressurized oil act as positive force of restoration to the right. In this manner, the spool 5 continues its movements to the left until the transient axial force balances with the force of inertia and damping resistance, and stops at a position where these forces become balanced. However, as the force of restoration still continues to act, the spool 5 starts movement to the right and causes self-excited vibration in the proximity of the inflow ports 11, 11'.

In this manner, feed of the pressure oil from the inflow passage causes the spool to repeat its function by the self-excited vibration continuously, and the spool 5 repeats its sliding movement continuously, thereby the alternate oil pressure from the outflow ports is transmitted to a vibrator to perform various types of vibration works efficiently.

Figure 6:
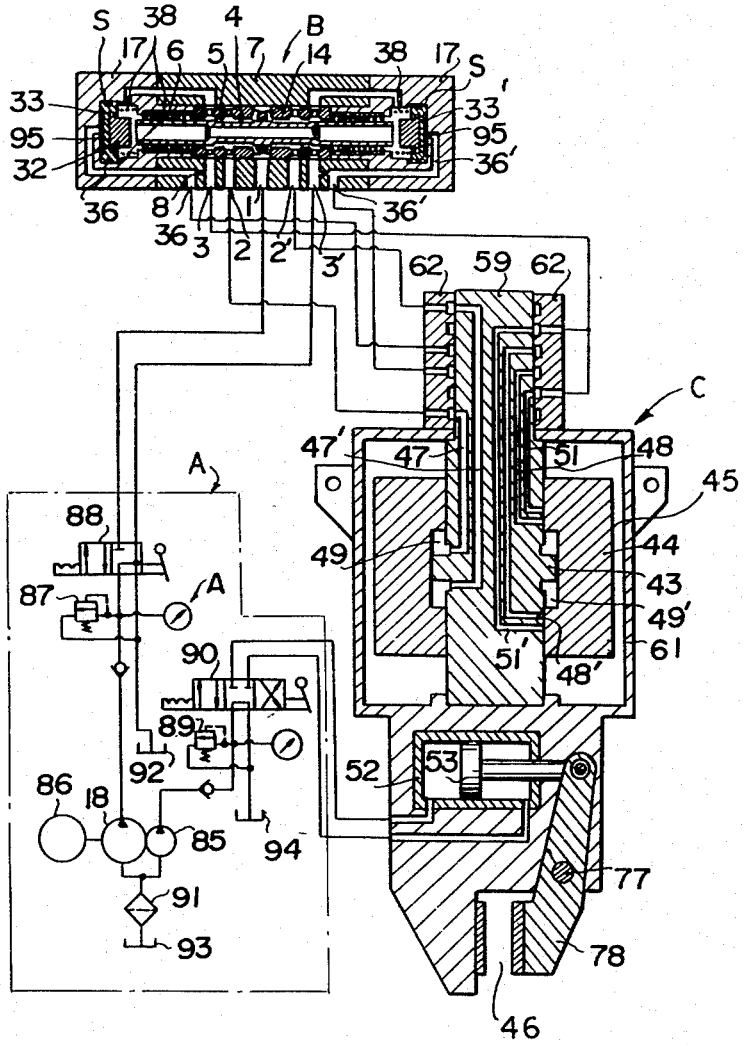
FIG. 6 is a transverse cross section showing an example of vibration working device operated by the embodiment shown in FIG. 4.

In the embodiment shown in FIG. 6, the configuration of this embodiment comprises the oil pressure source A, the oscillator B and a cylinder-type vibrator C. That is, a pressure oil source A having an oil pressure pump 18 is connected to the main body 7 of the oscillator B which has the oil pressure inflow passage 1, the outflow passages 2, 2', the oil exhaust passages 3, 3', and a self-excited vibratory member 5 inside the spool-fitting hole 4. The hydraulic oscillator B in this embodiment has a variable frequency and is connected to the cylinder-type vibrator C having a piston 43 and a cylinder tube 44, and one end of said vibrator C has a vibration load 45 of a predetermined weight while the other end has an engaging section 46 to engage with operation tools and the like. The cylinder-type vibrator C is supplied with the alternating flow at the forward and rear of the piston 43 by the oscillator B. In addition, in the oscillator B, there is provided the elastic devices S in the proximity of both ends of stroke of the vibratory member 5 so that cumulative deviation in the relative displacement between the piston 43 and the cylinder 44 in the vibratory C may be fed back to the vibratory member 5. Similarly, the oil pressure from sensing ports 48, 48' provided at the forward and rear of the piston 43 is led to a regulation pressure chamber 95 behing the piston 33 of the resilient device S so to regulate the distribution of stroke of the vibratory member to the right and left in one period thereby compensating for the cumulative deviation. At the same time, the oil exhaust ports 51, 51' are provided respectively to the outside of said sensing ports 48, 48' in such a fashion that the deviation at the start may be compensated and thus the above-mentioned vibration load may start its vibration at the middle of stroke.

A movable arm 78 as a chuck of the above-mentioned engaging section 46 is supported axially by a support shaft 77. The other end of arm 78 is connected to the piston 53 inside the cylinder 52 interlocked with the oil pressure source A. As such, the movable arm 78 functions to connect the operation system of the engaging section 46 of a work tool and the like to be provided to the aforementioned vibrator to the oil pressure source and regulate the same hydraulically.

As shown in FIG. 6, in the above-mentioned oil pressure oscillator B, the spool 5 is supported by the bearings 6, 6' so as not to touch the inner wall of the oil pressure chamber 4, both edge sections of said vibratory member having the pressure chambers 95. The piston 33 is fitted into said pressure chamber 95 and urged outwardly by the springs 38. Further, the resilient devices S in this embodiment comprise a resilient member 32 with the piston 33.

In every embodiment of this invention care is taken so that the vibration load is vibrated at the middle of vibration stroke of the vibrator C, and that the oscillation may not be stopped when it impacts the stroke end.

In order to vibrate the vibration load at the middle of the stroke, the distribution of stroke to the right and left in one period of the spool 5 of the oscillator is varied by the pressurized oil from the sensing ports 48, 48' of the cylinder, whereby the oil volume introduced into the cylinder chambers 49, 49' of the cylinder tube 44 is varied. In the embodiment of FIG. 4, the throttle passages 8, 8', 39, 39' are provided respectively between the oil exhaust passage 3 and the inflow passage 36, and between the oil exhaust passage 3 and the outflow passage 2, wherein the throttle passage 8' is used as a constant escape throttle at the time of oscillation. The throttle passages 8, 8' may be omitted in a case where the oil pressure inside the cylinder chamber 49 or 49' is connected to the tank 5 through the oil exhaust ports 51, 51' as shown in FIG. 6. Alternatively, the arrangement as shown in FIG. 5 may be employed.

Incidentally, the oil exhaust ports 51, 51' (FIG. 6) as well as the sensing ports 48, 48' opened by the piston rod 59 of the cylinder tube 44 are closed when the vibration load is located at the normal middle position of the stroke, and are bored at positions of desired dimension where there is a lapping length which is bigger than the predetermined amplitude of the vibration load. In other words, the oil exhaust ports are bored at desired positions outside of the sensing ports 48, 48', and are open when the vibration load is placed either to the uppermost or the lowermost position. When stopped, the vibration load is placed at the lowermost edge, and the ports 51, 48 are open while the ports 51', 48' are closed at this time.

Instead of hydraulic means, regulation of the piston 33 of the resilient device S may also be made by mechanical means such as a linking mechanism (which moves in interlock with the deviation of the vibration center of the vibration load), and the sensing ports 48, 48' as well as the inflow passage 36 are not required in this case.

When the oil is fed into the oil pressure oscillator B from the oil pressure source A through a change valve 88 in the embodiment of FIG. 6, the spool 5 starts self-excited vibration, and the oil is alternately distributed from the outflow passages 2, 2' to impart the alternate oil pressure through the operation circuit 47, 47' to the cylinder chambers 49, 49' at the forward and rear of the vibrator C, whereupon the cylinder 44, which has a predetermined load starts vibration in a predetermined amplitude vertically. Vertical vibration of the cylinder tube 44 applies shock, for example, to a pile fitted to the engaging section 46 in the case of a pile driver and drives the pile into the ground.

When the change valve 88 of the oil pressure source A is changed over to feed the pressure oil to the oscillator B and in consequence the spool 5 moves to the right, the pressurized oil is passed en route from the inflow port 1 — outflow port 2 — operation circuit 47 — cylinder chamber 49, the cylinder tube 44 is elevated upwardly. On the other hand, the exhaust oil escapes en route from the cylinder chamber 49' — operation circuit 47' — outflow passage 2' — oil exhaust passage 3' — tank 92. When the spool 5 moves leftwardly, the pressure oil is fed to the cylinder chamber 49' via the inflow passage 1 — outflow passage 2' — operation circuit 47' to push down the cylinder tube 44. In this case, the exhaust oil escapes through the cylinder chamber 49 — operation circuit 47 — outflow passage 2 — oil exhaust passage 3 — tank 92. At the starting condition where the ports 51 and 48 are closed but the ports 51', 48' are open, the pressurized oil fed into the cylinder chamber 49' returns back to the oil tank 92 through the oil exhaust port 51'.

Accordingly, the pressure oil is fed only to the upper cylinder chamber 49 of the cylinder tube 44, whereby the cylinder tube 44 restores the neutral, i.e., normal position. Thus, the vibrator C starts vibration with the piston 43 at the middle position, that is to say, the center of the stroke. When at the middle position, intrinsic vibration coefficient due to compressibility of the oil used may be equalized to the vibration used so as to cause resonance so that vibration work may be carried out more effectively.

To cope with upward deviation of the cylinder tube 44, the pressurized oil is arranged to return the oil tank 92 by means of the oil exhaust port 51.

When the sensing port 48' is opened by cumulative deviation of the stroke center of the cylinder tube 44, i.e., the vibration load, the pressure is elevated after it passes through the cylinder chamber 49', the sensing port 48 and the inflow passage 36 to the rear of the pressure chamber 95 of the left resilient device S and is throttled by the throttle hole 8, thereby the piston 32 starts to move rightwardly against the action of the spring 38 and functions so as to lessen the leftward stroke. At the same time, the volume of the oil fed from the outflow passage 2' to the cylinder chamber 49' is made less than the volume of the oil fed from the outflow port 2 to the cylinder chamber 49, whereupon the cylinder 44 moves in a direction to close the sensing port 48', and cumulative deviation can therefore be compensated without discharging the pressurized oil to the tank. The above-mentioned functions are reversed when the sensing port 48 is opened, so that the vibrator C can be operated efficiently and stably at all times.

The pressurized oil is vented from the oil exhaust ports 51, 51' to the tank only when it is regulated to compensate larger deviation of the cylinder tube 44 at the time of starting or the like occasion; thereafter the stroke of the spool 5 is varied by moving the pistons 33, 33' of the oscillator B so as to thereby enable the distribution of the spool 5 from the neutral position to the right and left. In consequence, the volume of the oil from the outflow passage 2, 2' to the cylinder chamber 49, 49' can be varied to always ensure stable and efficient vibration of the cylinder tube 44 around the neutral position.

Figure 7:
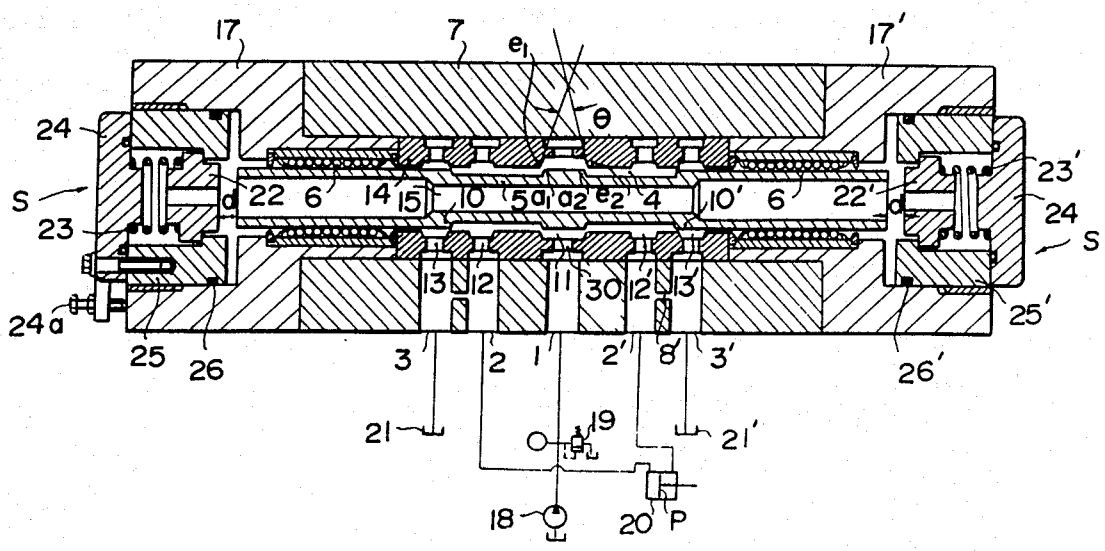
FIG. 7 is a diagrammatical view showing still another embodiment of the present invention.

The oscillator valve in the embodiment in FIG. 7 is characterized in that a single annular groove 11 is used instead of the bushing 14 having the pressure oil inflow ports 11, 11', of the embodiment in FIG. 1, said annular groove having an opening of the inflow port which surrounds the center land of the spool with a predetermined spacing and opens inwardly with walls diverging at a predetermined angle $\theta$.

The opening of the pressurized oil inflow passage 1 distributes the pressure oil to the right and left into the spool fitting hole 4, at a predetermined angle of divergence to generate a force of fluid restoration exerted by the pressurized oil to the spool, and is provided with the inflow port 11 which is formed into an annular groove having a predetermined spacing with the center land 9. The width of the opening of the inflow port 11 is bigger than the width of the center land 9 to provide a minus-lap.

The other constructions are substantilly the same as those of the embodiment of FIG. 1 and substantially the same functions are carried out also in this embodiment. However, since the annular inflow port 11 connecting to the inflow passage 1 is provided so as to enlarge the open area between the spool 5 and the center land 9 with a predetermined spacing therebetween, a bigger output can be obtained by a smaller construction in this embodiment with a smaller resistance for a larger flow volume of the pressurized oil.

Both walls of the annular inflow port 11 opens inwardly with a predetermined angle $\theta$ so as to afford the spool the force of fluid restoration. In consequence, if the edges $a_1$, $a_2$ (FIG. 7) of the center land 9 of the spool 5 are so arranged that the ends of spool 5 impact the stoppers 22, 22' at desired positions where edges $a_1$ and $a_2$ do not pass over the openings $e_1$, $e_2$, the center land 9 does not entirely come off from the range of width of the annular groove of the inflow port 11, and the spool 5 is accelerated by transient flow until it impacts the stoppers 22, 22'. Only after the spool 5 impacts the stoppers 22, 22' does the flow of oil become constant and the spool is subjected to force of restoration. Accordingly, the spool 5 is accelerated, and the frequency is enhanced.

The frequency can further be varied by changing the opening angle $\theta$ of the inflow port 11 connecting the inflow passage 1.

Although the inflow port 11 is not necessarily provided to the entire periphery, such shape is easier to fabricate and may be used also in the above-mentioned embodiment with advantage.

FIGS. 8 through 13, inclusive, illustrate several embodiments wherein the oil pressure oscillator comprises a pilot valve which is brought by the pressurized oil into self-excited vibration, and a main valve which is driven by said pilot valve.

Figure 8:
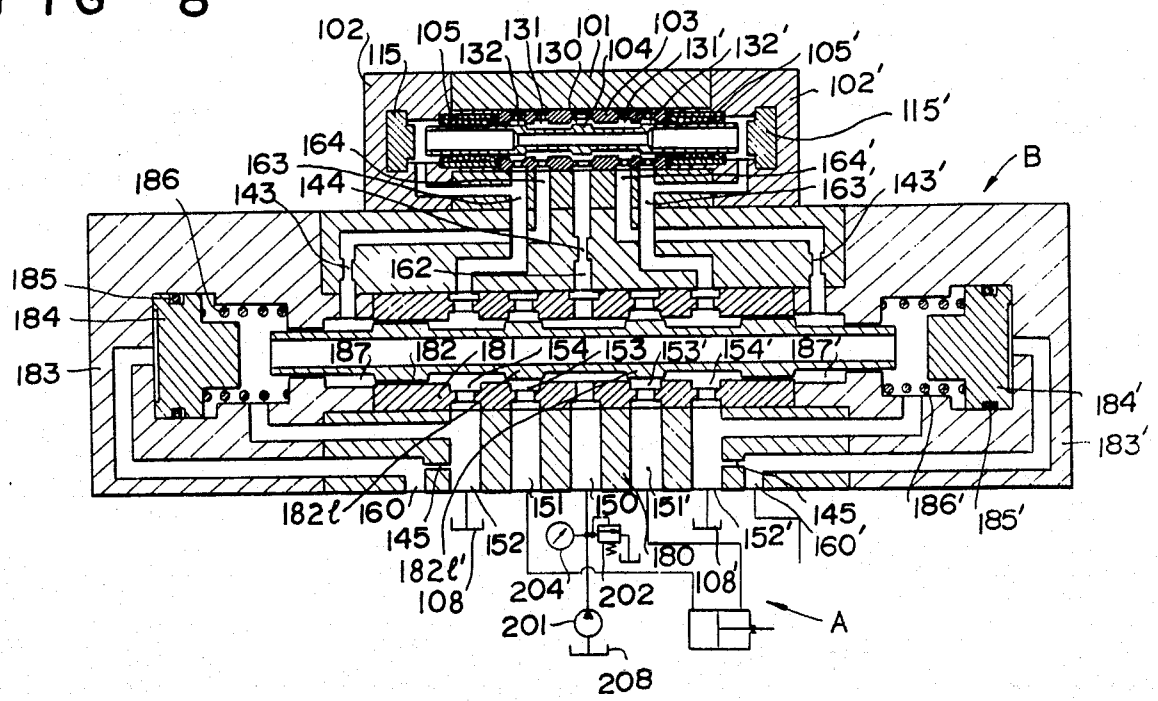
FIG. 8 is a diagrammatical view showing another embodiment of the present invention in which a regulating device for controlling the output flow rate of the output alternating flow functioning as an amplifier is incorporated in the hydraulic oscillator.

In the embodiment of FIG. 8, the oil pressure oscillator B which is brought to hydraulic vibration by the pressurized oil from the oil pressure source A comprises a pilot spool 104 as a self-excited oscillating vibratory member, a pilot valve 101 as a self-excited oscillation valve which incorporates said pilot spool 104, and a main valve 180 as an amplifier incorporating a main spool which is driven by the alternating pressurized oil of said pilot valve 101.

The spool 104 of the pilot valve 101 is made hollow so as to decrease the inertia of said spool and repulsive resistance of the drain at both ends. The spool has a land which is formed so as to be a minus-lap against the inflow port 130. The spool 104 has also a predetermined spacing between it and the sleeve 103, and is supported at its both ends by the axially directed bearings 105, 105' to minimize the damping resistance.

The inflow port 130 of the sleeve 103 is constituted as a single annular groove having a desired, predetermined opening angle, so that the distance between the inflow port, outflow port and exhaust port is enlarged, the length of the damping is increased and transient axial force may be enlarged. Moreover, the vibration amplitude of the spool 104 is regulated to a desired value by the stoppers 115, 115', and the transient axial force vanishes only after the spool 104 impacts said stoppers. In addition to the force of fluid restoration, the spool is aided by the mechanical force of restoration resulting from repulsion of the stoppers 115, 115' to continue stable vibration.

Figure 9:
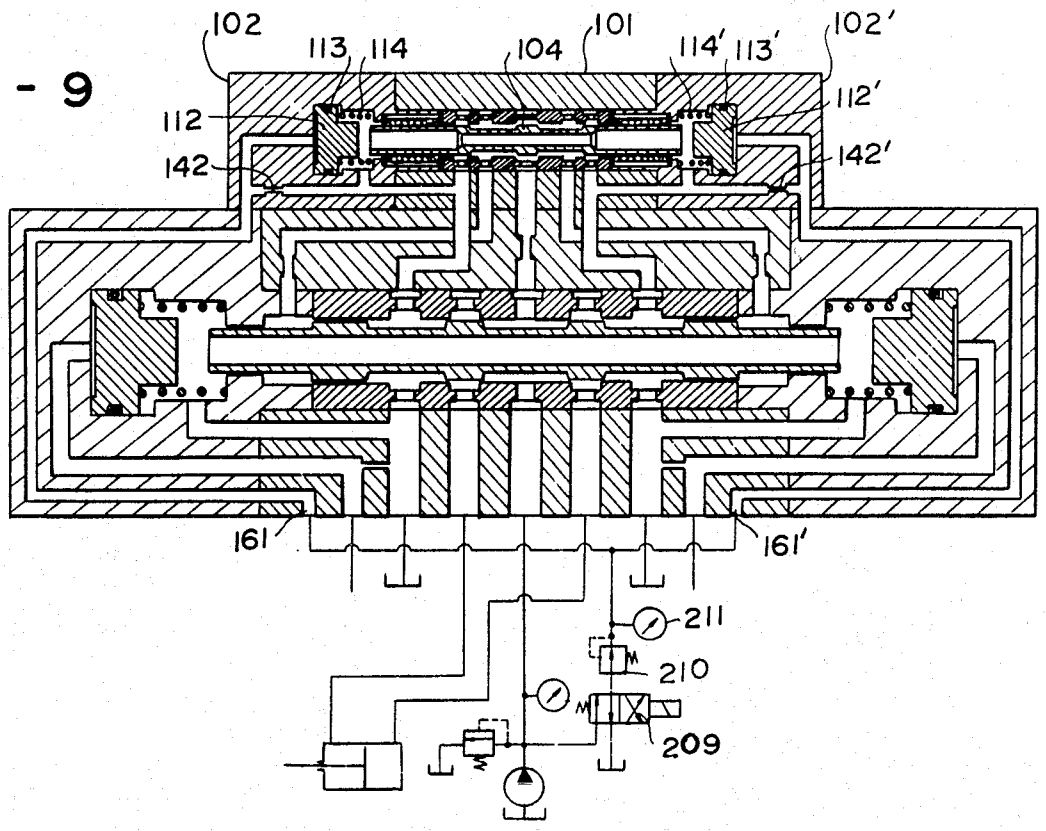
FIGS. 9 – 13 are diagrammatical views showing several examples of the embodiment of the present invention shown in FIG. 8.
Figure 10:
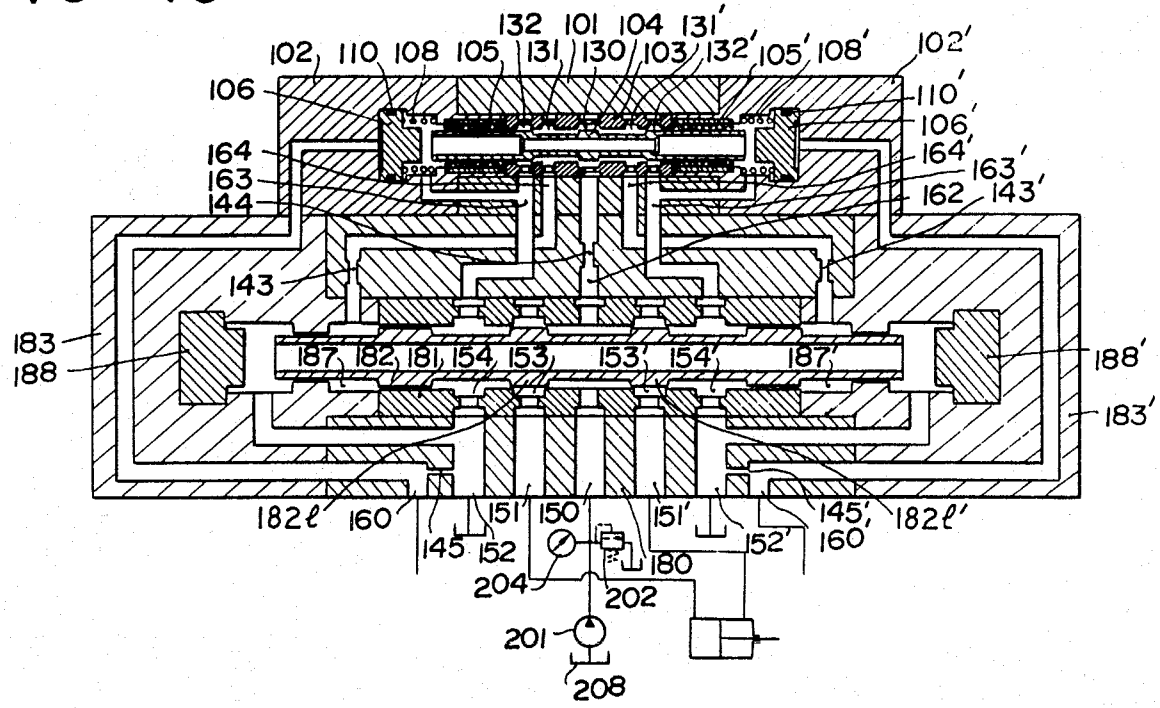

Instead of a stationary type, the stoppers 115, 115' may also be a movable type as shown in FIG. 9 wherein they are formed as frequency regulating stoppers 112, 112' which are fitted slidably into the pilot valve covers 102, 102' and equipped with the spring 114 and 114'. In this embodiment, the frequency of the alternating oil pressure is regulated by changing the spool amplitude of the pivot valve 101, but not by changing the rate of inflow of pressurized oil through the pilot valve 101 rather while keeping the oil pressure constant. The lower limit of the frequency in this case is determined when the frequency regulating stoppers 112, 112' are at the normal position, as their positioning can be regulated by external pressure oil so as to thereby regulate the frequency of the output alternating pressurized oil.

Alternatively, the regulating stoppers may also be made up of a combination of slidable pistons 107, 107' (FIG. 11) and output flow ratio regulating stoppers 106, 106'. The regulating stoppers 106, 106' having springs 108, 108' as well as regulating pistons having springs 109, 109' are respectively fitted slidably into pilot valve covers 102, 102' so that the frequency and output flow ratio can be regulated by the pilot valve 101.

As noted previously, the main spool 182 (FIG. 10) of the main valve 180 has lands **182*l*, 182*l*' which oppose to outflow ports 153, 153' and is hollow so as to lessen the force of inertia and repulsive resistance of the drain at both edges. In order also to lessen the operation pilot oil pressure, the pilot pressure chamber is actuated by the difference between the outer cross-sectional area of the spool land and that of both of the ends of the spool it is not applied with force by spring or the like to be permitted in a free state, and is regulated by the stoppers 188, 188'** to not more than the amplitude which is actuated by the pilot pressurized oil.

The frequency of the output alternating pressurized oil can be varied by changing the volume of the pressurized oil flowing into the pilot valve 101, or by changing the amplitude of the spool 104 of the pilot valve 101. Namely the frequency can be changed by changing the period of the spool 104. The adjustment of the flow ratio of the output alternating oil pressure to the right and left in this instance can effectively be made either by changing the open area ratio of the main valve 180 by the use of the stoppers 188, 188' or by changing the speed of reciprocation of the spool 182 of the main valve 180.

In these Figures, numerals 110, 110', 111, 111', 113 and 113' (FIG. 10) are the oil seals; 130 is the pilot pressure oil inflow port; 131 and 131' are the pilot pressure oil outflow ports; 132 and 132' are the pilot oil exhaust ports; 133 and 133' are the grooves, 142, 142', 143, 143', 145, 145', 146 and 146' are the throttle valves; 144 is the regulating valve of the pilot pressurized oil; 150 is the pressurized oil inflow port; 153 and 153' are the pressurized oil outflow ports; 154 and 154' are the oil exhaust ports; 160 and 160' (FIG. 11) are the flow-ratio regulation oil passages; 161 and 161' are the frequency regulation oil passages; 162 (FIG. 12) is the pilot pressurized oil inflow passage; 163 and 163' are the pilot pressurized oil outflow passages; 164 and 164' (FIG. 10) are the pilot pressurized oil exhaust passages; 181 is the main valve sleeve; 183 and 183' are the main valve covers; 185, 185' (FIG. 8), 192, 192', 193 (FIG. 14) are the oil seals; 186 and 186' ae the springs; 188 and 188' are the stoppers; 190 (FIG. 14) is a piston; 191 is a cylinder tube; 194 and 194' are cylinder ports; 195 and 195' are oil exhaust ports; 196 and 196' are sensing ports; 197 and 197' are cylinder chambers; 201 is an oil pressure pump; 202 is a pressure regulating valve; 203 is a switch valve; 204 is a pressure gauge; 205 is a check valve; 206 is the driving source of pump 201; 207 is a strainer; 208 is an oil tank; 209 (FIG. 11) is a switch valve; 210 (FIG. 10) is a pressure regulation valve and 211 (FIG. 11) is a pressure gauge.

At the inlet port of the pilot valve, pressurized oil is regulated by the regulating valve 144 (FIG. 10) to produce a desired frequency of the output alternating pressurized oil, and the pressurized oil so regulated flows out through the pressurized oil outflow passages 164, 164' as the alternating pressure oil by the self-excited vibration of the pilot spool 104, and then throttled properly by the throttle valves 143, 143' so that it flows into the pressure chambers 187, 187' alternately, and the spool 182 of the main valve continues its translation until it impacts the stoppers 188, 188'.

In consequence, the inflow of pressurized oil to the main valve 180 is changed over by the vibration of the spool 182, and the oil flows out to the pressurized oil outflow passages 151, 151' as the alternating pressurized oil to the machine to be operated by said pressurized oil.

The exhaust passages 163, 163' send back the returning pressurized oil from the pilot pressure chamber alternately through the exhaust passages 152, 152' of the main valve, while the exhaust passages 152, 152' send back the returning pressure oil from the outflow passages 151, 151' alternately to the tank.

When the external signal pressure oil flows to either of the external oil pressure passages 160 or 160' in excess of that which throttle valves 145 and 145' can regulate, the stoppers 184 and 184' (FIG. 8) move inwardly against the stroke end, thereby regulating the flow-ratio of the pressurized oil outflow passages 151, 151'. More specifically, the displacement of the spool 182 changes to the right or left so as to change the open area of the pressurized oil outflow port 153 or 153' together with the output flow ratio. When the feed of the external signal pressure oil stops, the pressure oil behind the flow-ratio regulation stopper 84 (FIG. 8) or 184' is fed back to the tank via the throttle valve 145 or 145' by the spring 186 or 186' whereby the flow-ratio regulation stopper 184 or 184' is placed to the normal position.

Figure 14:
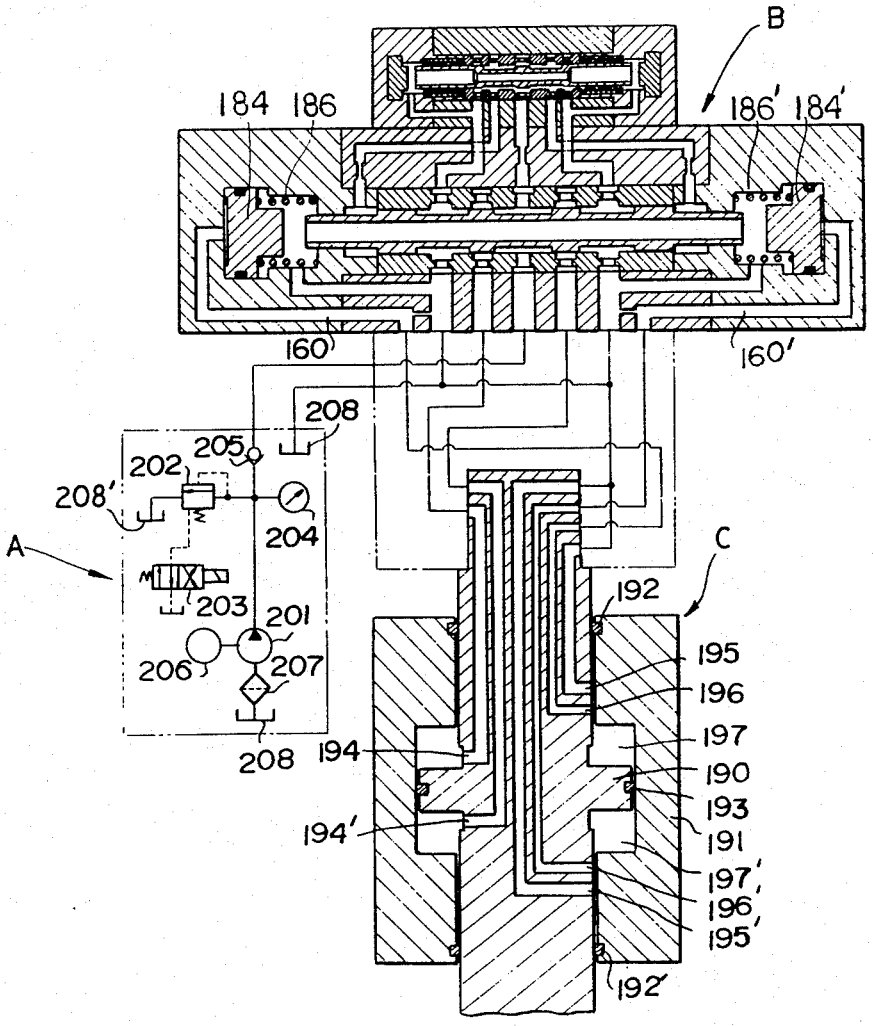
FIGS. 14 and 15 are diagrammatical views showing other examples of the embodiment of the present invention.

In FIGS. 8 and 14, the pressurized oil from pump 201, regulated by pressure regulating valve 202, is branched from inflow passage 150 of main valve 180 to the pilot valve inflow passage, the pilot valve inflow pressure oil of which is then regulated by regulation valve 144 to a desired level and charged to the inflow port 130.

When pilot spool 104 moves leftwards in this instance, the pressurized oil passes through outflow passage 164' and flows into the pilot pressure chamber 187' via the throttle valve 143 to thereby push the spool 182 leftwards, whereupon the exhaust oil from pilot pressure chamber 187 returns through outflow passage 164 via throttle valve 143 back to the tank 108 from the valve chamber through the exhaust passage 163. When the pilot spool 104 moves rightwards, the above-mentioned sequence of operation is reversed, whereby the spool 182 moves rightwards and repeats its operation. In the embodiment of FIG. 14 the output alternating pressurized oil is charged into cylinder ports 194, 194' of the vibrator C alternately and causes cylinder tube 191 to vibrate vertically.

The sensing ports 196, 196' of the vibrator C as well as the oil exhaust ports 195, 195' are emplaced symmetrically with piston 190 as the center at positions where there is a lapping region in view of the vibration amplitude of the cylinder tube 191, and the ports are opened when the cylinder tube 191 deviates to a certain extent from the center of the stroke.

The oil exhaust ports 195, 195' which are spaced from the sensing ports 196, 196' at a predetermined distance are opened when the cylinder tube 191 is located at either the uppermost or lowermost position. Accordingly, when the cylinder tube 191 initiates its operation from the uppermost or the lowermost position, or when it passes over the oil exhaust port for some reason or other to open the oil exhaust port, the pressurized oil from the cylinder chambers 197, 197' rapidly returns to tanks 208 and 208' so as to thereby return the cylinder tube 191 rapidly.

On the other hand, when the center position of the vibrator is somehow deviated during the vibration of the cylinder tube, for example, when the cylinder tube is deviated downwardly, the lower sensing port 196 which has been closed is opened, in consequence of which the pressurized oil from the cylinder chamber 197 flows into the rear of the flow ratio regulating stopper 184 from the sensing port 196 through the external signal pessure oil inflow passage 160. If the cylinder is deviated upward, oil from cylinder chamber 197' flows through passage 160' to the rear of stopper 184', and overcomes the action of spring 186'. The spool impacts stopper 184' and is reversed. In this case, the flow ratio regulation stopper 184 is retained at the normal position since the upper sensing port 196 is closed.

Displacement of the spool 182 becomes smaller to the right than to the left, and the open area of the outflow port 153' becomes smaller than that of the outflow port 153. Since the flow volume charged from the cylinder port 194' to the cylinder member 197' becomes smaller than the volume fed from the cylinder port 194 to the cylinder chamber 197, the flow pressure fed to the vibrator C increases until the cylinder tube 191 closes the sensing port 196', and when the sensing port 196' is closed, the pressurized oil behind the flow-ratio regulating stopper 184' is also stopped and returned back to the tank by the spring 186' through the throttle valve 145'. Simultaneously the flow-ratio regulation stopper 184' returns to the normal position so as to afford stable vibration to the vibrator C irrespective of the weight of the load.

Figure 12:
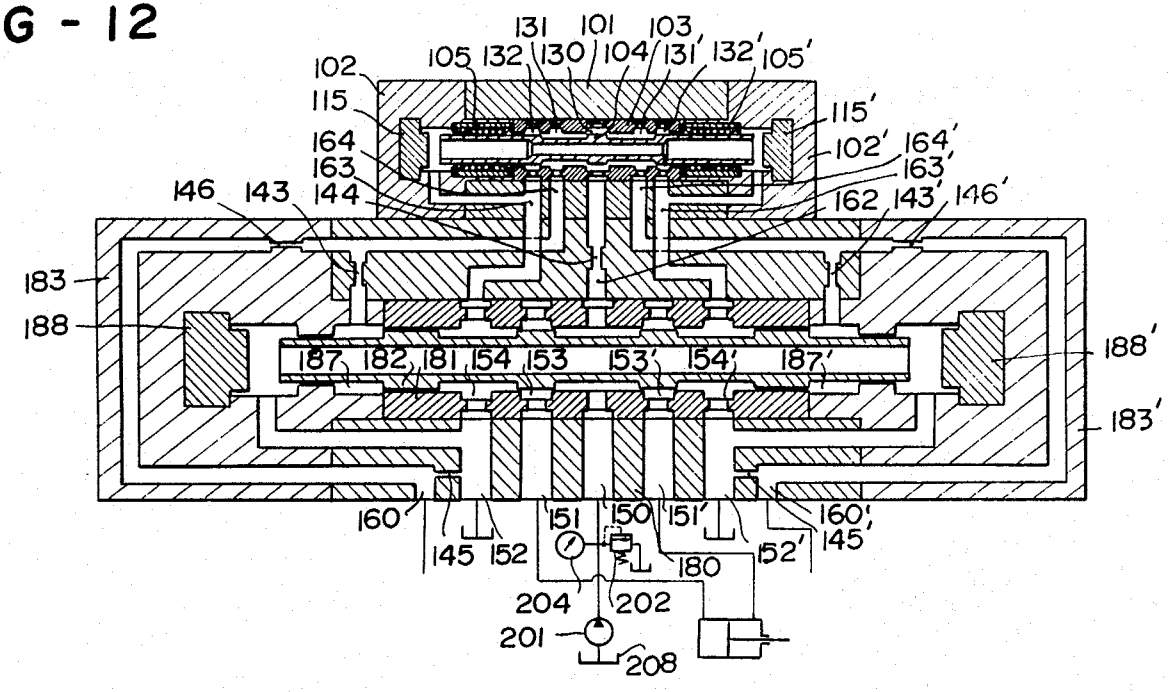

In the embodiment of FIG. 12, the output flow ratio regulation is effected by regulating the external signal oil pressure appropriately by the throttle valve 146 or 146' joining them with the pilot pressure oil of the pilot pressure oil outflow passages 164 or 164', further regulating them properly by the throttle valve 143 or 143' and then flowing into the pilot pressure chambers 187 or 187'. In other words, the flow volume flowing into the pilot pressure chambers 187 and 187' is caried so as to differentiate the right and left speeds of the spool 182 and also very the flow of the output outflow passages 151, 151'.

Figure 13:
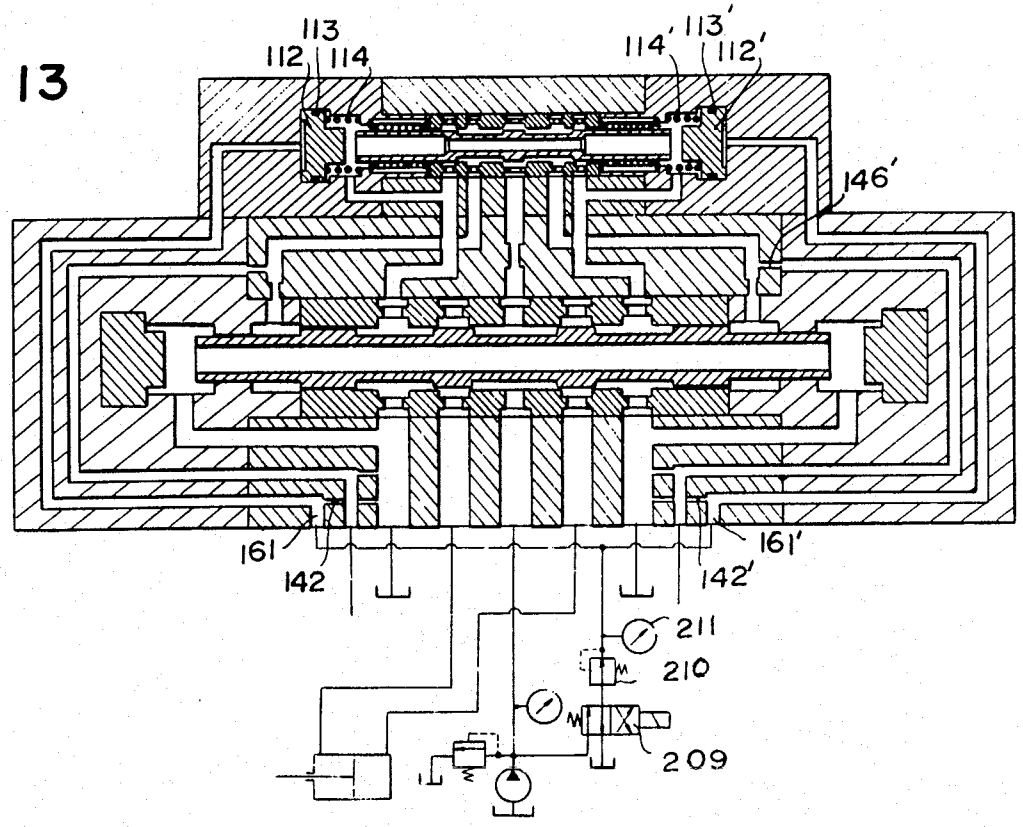

In FIG. 13, the same construction is employed for the regulation of frequency with that of FIG. 9 and for the output flow ratio regulation with that of FIG. 12.

Figure 15:
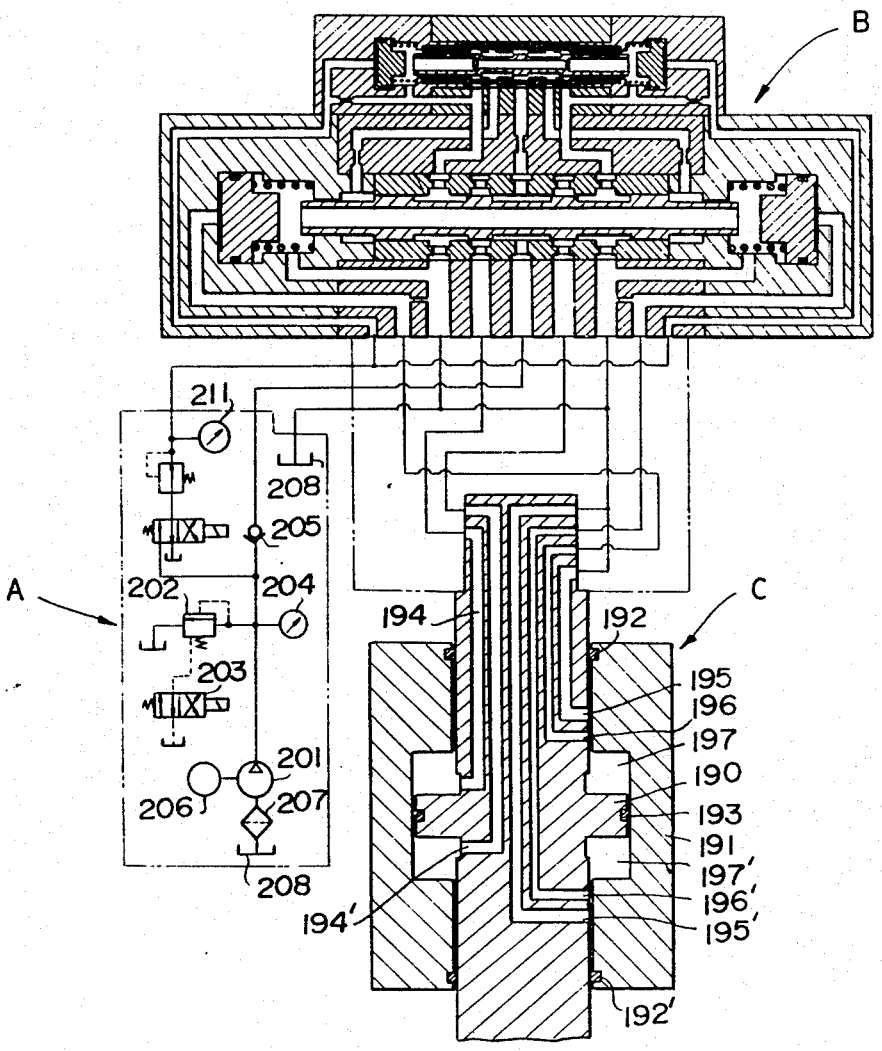

FIGS. 14 and 15 illustrate typical applications of the present oscillator for use in vibration works such as a pile driver or a stone crusher wherein the vibrator member of the hydraulic oscillator self-oscillates by the oil pressure from the oil pressure source to generate the alternating oil pressure which, in turn, changes and actuates the main valve. The alternating oil pressure thus generated at the outflow port of the main valve is then imparted to the vibrating section provided with vibration load so as to generate the vibrating force to the vibrating section, said vibration load being vibrated in the middle of the stroke of the vibrating section, whereby cumulative deviation due to relative displacement thereof is fed back to the main valve.

The oil pressure oscillator as a pilot valve is interconnected to a cylinder-type vibrator provided with a vibration load via an amplifier valve which is the main valve. In this configuration, the alternating oil pressure generated at the exhaust port of the amplifier valve by the self-excited vibration of the vibratory member of the oscillator is applied to the front and rear of the piston of cylinder of the vibrator to obtain vibrating force by the vibration of the vibration load wherein the sensing ports at the front and the rear of the piston are interlocked with the regulating pressure chamber of the elastic devices provided at both ends of the spool of the above-mentioned amplifier valve to compensate cumulative deviation, and at the same time the oil exhaust ports are disposed respectively at the outside of the sensing ports.

In FIGS. 8 through 15, when the pilot circuit connecting the outflow ports 131, 131' of the pilot valve 101 to the pressure oil chambers 187, 187' for the operation of the main valve 101 is connected to the feed-back circuit from the machine to be driven through a throttle mechanism, there is obtained a feed-back system which regulates directly the inflow pressurized oil volume to the main spool operation pressure oil chamber with quick response and which can be regulated by the throttle valve for stable feed-back regulation.

Moreover, the inflow port of the pilot valve may be connected, via a throttle valve, to the same hydraulic sourc with that of the main valve to set to desired conditions so as to facilitate the regulation of frequency. Likewise, the outflow port of the pilot valve may be connected, via a throttle valve, to the main spool operation pressure oil chamber to cause stable vibration of the main spool.

Figure 11:
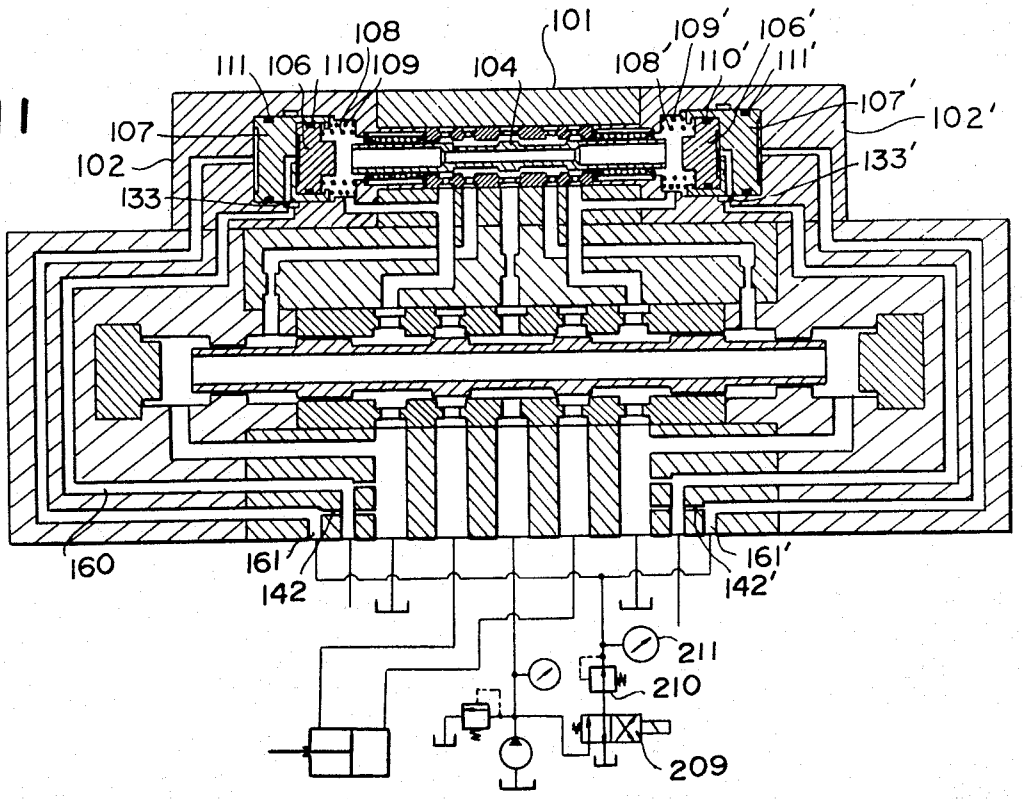
Figure 16:
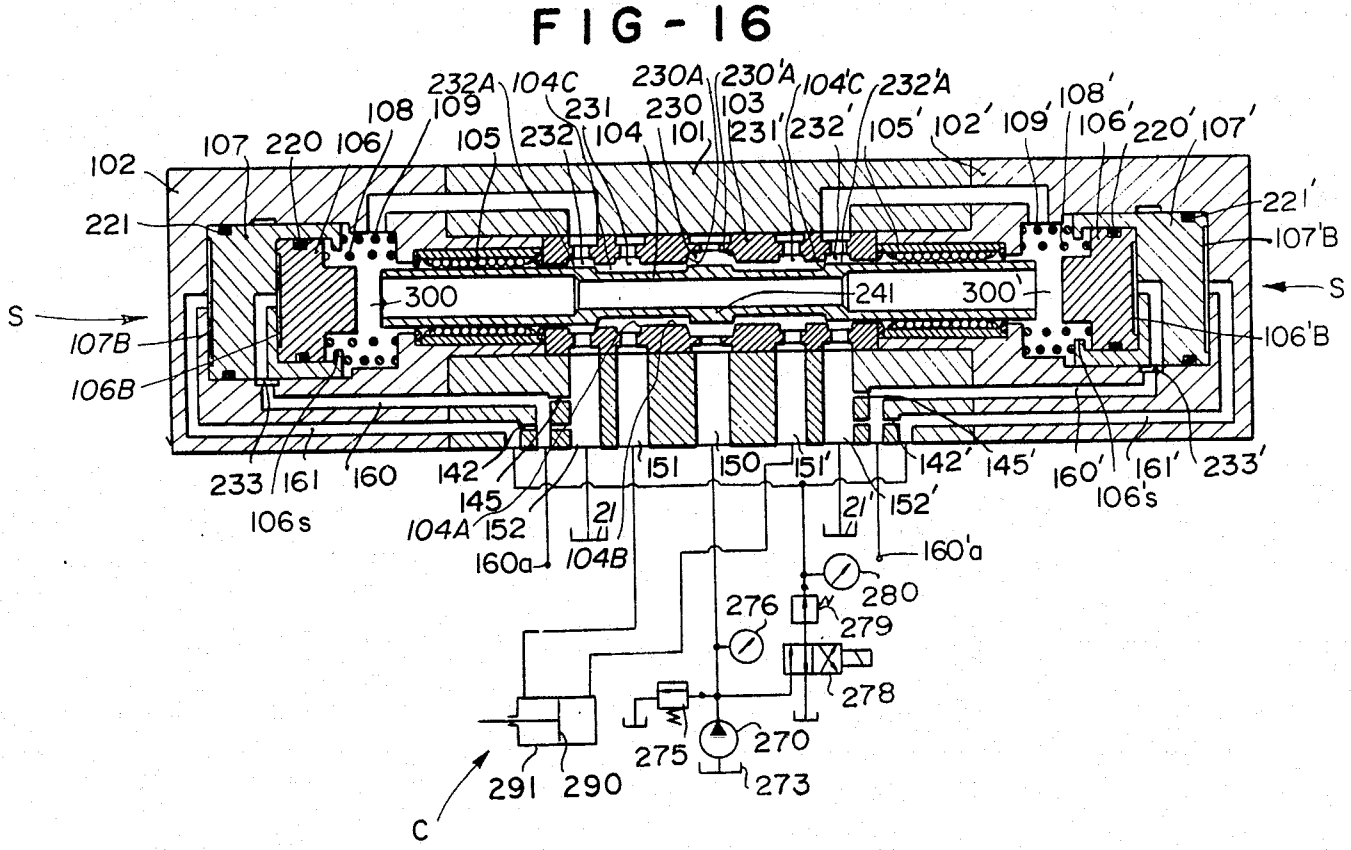
FIG. 16 is a diagrammatical view showing an embodiment of the present invention in which the hydraulic oscillator incorporates a regulation device for the regulation of the amplitude of a self-excited vibrating member so as to adjust the vibration frequency as well as the flow-ratio thereof.

The embodiment of FIG. 16 embraces a part of the configuration of the embodiment in FIG. 11 wherein frequency as well as the flow-ratio of the output alternate pressure oil can be changed continuously and properly with efficiency and extreme ease while the pressure or volume of the pressurized oil flowing into the oil pressure oscillator is kept constant. In this embodiment, the vibration frequency can be changed by changing the displacement of the spool 104 from the center of the inflow port 230 to the right and left to the same extent, while the flow-ratio can be changed by changing the displacement to either of the two sides. This double-construction type resilient devices S can be used with advantages. Namely the resilient devices S for regulation of the displacement of the spool 104 comprise the flow-ratio regulation stoppers 106, 106' fitted slidably to the frequency regulation pistons 107, 107' which are respectively urged and retained at normal positions by the springs 109, 109', and 108 and 108'.

With the proviso that the pressure (or flow volume) of the pressurized oil flowing from the pressurized oil inflow passage 150 (leading to inflow port 230 with inwardly diverging walls 230A and 230A') of the valve main body 101 is constant, sizes of the pistons 107, 107' as well as the stoppers 106, 106' are determined so that the displacement of the spool 104 from the center of the inflow port 230 to the right and left is in a predetermined range. While setting the frequency of the output alternating pressurized oil as the lower limit when the stoppers 106, 106' and the pistons 107, 107' are at the normal position, the valve main body 101 is provided with the frequency regulation pressure oil inflow passages 161, 161' and the flow-ratio regulation pressure oil inflow passages 160, 160' so as to equalize the flow volumes from the output pressure oil outflow passges 151, 151', wherein said inflow passages 160, 160' are connected to the back pressure chamber 106B, 106'B of the stoppers 106, 106' and said inflow passages 161, 161' are connected to the back pressure chambers 107B, 107'B of the pistons 107, 107', while all of said inflow passages 160, 160', 161, 161' are connected to the outflow passages 152, 152' via the throttle valves 142, 142', 145, 145'.

Figure 17:
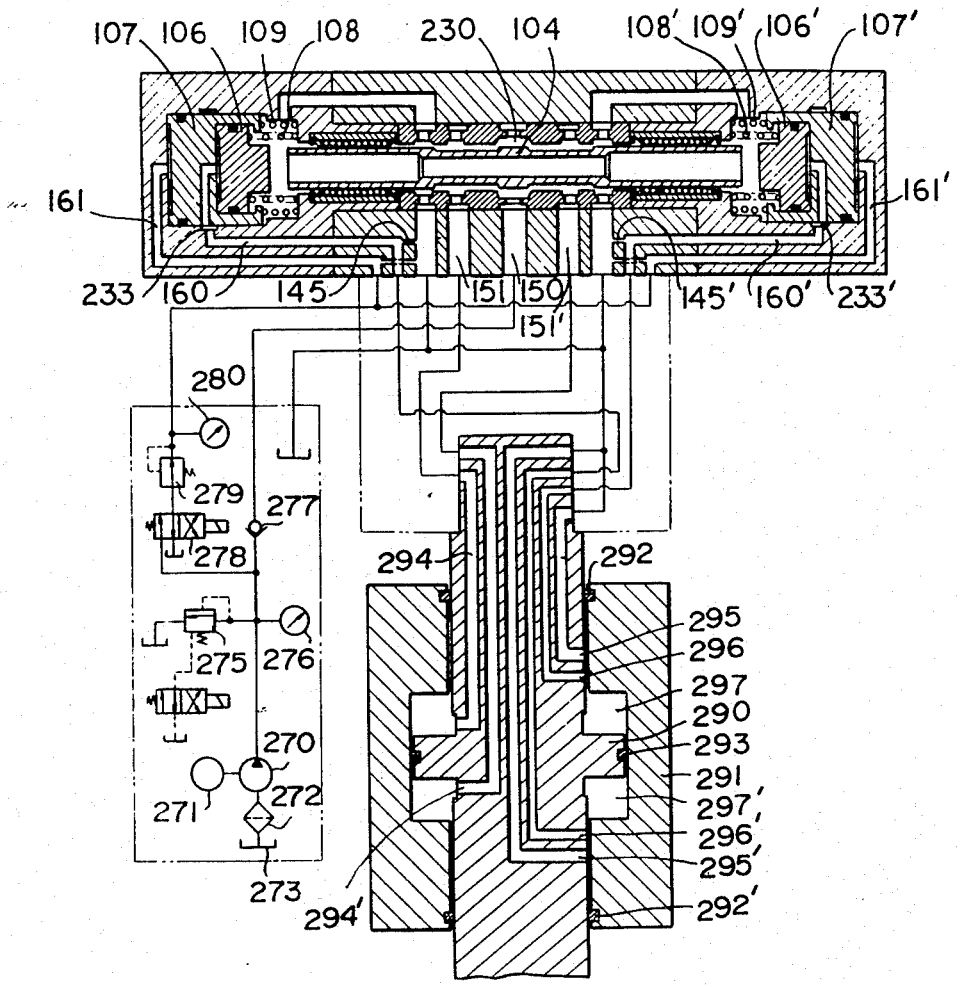
FIG. 17 is also a diagrammatical view showing another example of the embodiment of the present invention shown in FIG. 16.

The pair of the right and left pistons 107, 107' which regulate the stoppers 106, 106'are respectively fitted slidably into the oil pressure chamber 300, 300' defined in the covers 102, 102' of the oil pressure oscillator so as to oppose each other inwardly, each of which is pressed outwardly by the springs 109, 109'. The pair of the right and left stoppers 106, 106' may be of elastic material and are slidably provided in the pistons 107, 107', and pressed outwardly by the springs 108, 108', together with said pair of pistons 107, 107', the stoppers 106, 106' make up the resilient devices S which are provided in the proximity of both ends of the stroke of the spool 104. In this arrangement, by supplying a selected oil pressure to the rear of the pistons 107 and 107' simultaneously, the amplitude of the vibratory member can be adjusted as desired to facilitate the stable change of frequency. And also the distribution of the alternate oil pressure to the right and left (that is, the flow-rate) at the outflow port 151, 151' can be changed readily by charging hydraulic signals from an outside device, such as vibrator C to the rear of the right and left stoppers 106, 106' separately. Connection to such an outside device can be made at points indicated by the reference numerals 160*a* and 160'*a*. Such an outside device is shown in FIG. 17, connected to supply pressurized oil simultaneously to the rear of stoppers 106 and 106'.

In FIG. 16, the numerals 220, 220' indicate seals for the stoppers; 221, 221' are seals for the pistons; 231, 231' are output pressure oil outflow ports; 232, 232' are exhaust ports; 233, 233' are grooves; 270 is an oil pressure pump; 271 is the pump driving source; 272 is a filter; 273 is an oil tank; 274, 278 are switch valves; 275, 279 are pressure regulating valves; 276, 280 are pressure guages; 277 is the check valve; 290 is the piston; 291 is the cylinder tube of the vibrator.

When the switch valve 278 for frequency regulation is changed over to flow, the pressurized oil passes into inflow passages 161, 161' after it is regulated by the pressure regulating valve 279, the pressure oil such an excess volume that the throttle valves 142, 142' can regulate, passes into the back pressure chambers 107B, 107'B of the frequency regulation pistons 107, 107', moves said pistons 107, 107' together with the stoppers 106, 106' respectively inwards while overcoming the actions of the spring 109, 109', 108, 108' and finally the pistons 107, 107' stops and retains the position where it balances with the springs. Displacement of the spool 104 therefore becomes smaller and the period becomes smaller. In consequence, the frequency of the output alternate pressure oil becomes greater. When the switch valve 278 is changed over to stop the feed of the pressurized oil, the pressurized oil at the back pressure chamber 107B, 107'B of pistons 107, 107' escapes to the throttle valves 142, 142', and therefore the stoppers 106, 106' together with the pistons 107, 107' return to the normal position by the action of the springs 109, 109', 108, 108'.

When on the other hand the external signal pressure oil flows either into the flow-ratio regulation inflow passage 160 or 160' (but never simultaneously into both of the passages), it passed into the back pressure chamber 106B, 106'B of the stopper 106 or 106' through the groove 233 or 233' which never shuts said signal pressure oil, irrespective of the position of the pistons 107, 107'. And by the pressure oil in such an excess volume that the throttle valve 145 or 145' can regulate, the stopper 106 or 106' moves inwardly to the edge 106, 106' while overcoming the action of the spring 108 or 108'.

That is, since the displacement of the spool to the right and left is varied, the flow ratio is also therby changed. When the external signal pressure oil is stopped, the pressurized pressure oil at the back pressure chamber 106B, 106'B of the stopper 106 or 106' escapes to the tank through the throttle valve 145 or 145', whereby the stopper 106 and 106' returns to the normal position within the piston 107 or 107' by the action of the spring 108 or 108'.

In the vibrator as shown in FIG. 17, the pressure oil regulated by the pressure regulating valve 275 passes into the valve chamber from the inflow port 230 via the pressurized oil inflow passage 150 so as to cause the self-excited vibration of the spool 104, then flows into cylinder ports 294 and 294' alternately via outflow passages 151, 151' to actuate the top and bottom of the piston 290 and vibrates the cylinder tube 291.

Changing of the frequency in this instance can be made in the following manner:

When the switch valve 278 is opened, pressurized oil under control of pressure regulating valve 279 is fed into the rear of the pistons 107, 107' via the frequency regulation pressure oil inflow passages 161, 161', whereupon the pistons 107, 107' together with the stoppers 106, 106' move inwardly and stop at a desired position as noted previously, hence vibrational frequency of the spool 104 becomes higher as does the frequency of the output alternating flow. Consequently, the frequency of the cylinder tube 291 also increases.

On the other hand, both sensing ports 296, 296' and oil exhaust ports 295, 295' are emplaced symmetrically with respect to the center of the piston with their centers at positions relative to the center of the stroke of the cylinder tube 291. There is a lapping length which depends on the vibration amplitude, and the ports are open when the stroke of the cylinder thereof deviates to a certain extent.

The oil exhaust ports 295, 295', exterior to the sensing ports 296, 296', are spaced at a predetermined distance with respect to each other; ports 295 and 295' are open when the cylinder is located at either the uppermost or the lowermost position. When the center of the vibration of the cylinder tube 291 is somehow deviated, for instance, downwardly, the sensing port 296' is opened whereby the pressurized oil in cylinder chamber 297' passes through conduit 160, flows into the rear of the stopper 106 via the groove 233, and moves inwards while impacting and overcoming the spring 108. Accordingly, the displacement of the spool 104 becomes smaller to the left than to the right, and the flow ratio of the output pressure oil outflow passage 151' becomes smaller than that of the output pressure oil outflow port 151. Consequently, the rate of flow of pressurized oil from cylinder port 294' to the cylinder chamber 297' becomes smaller than the rate from the cylinder port 294 to the cylinder chamber 297, thereby elevating the cylinder tube 291 upwardly until the sensing port 296' is closed. (When the sensing port 296 is opened, the above-described sequence of operations is reversed.)

When the cylinder tube 291 initiates its movement either from the lowermost or the uppermost position, or when the engaging section of the cylinder tube 291 somehow passes over either the sensing port 296 or 296', the oil exhaust ports 295, 295' permit the pressurized oil of the cylinder chamber 297 or 297' to escape rapidly to the tank and restore the cylinder tube 291 rapidly to the center position.

It will be understood by those skilled in the art that many changes in the details of this invention as hereinbefore described and illustrated may be made without, however, departing from the spirit thereof or the scope of the appended claims.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention, which, as a matter of language, might be said to fall therebetween.

What is claimed is:

1. A hydraulic oscillator, said oscillator being self-excited, comprising a main body, said main body being equipped with an oil inflow port having inwardly divergent walls, a first pair of flow ports for alternately receiving and transmitting pressurized oil therethrough, an oil pressure chamber having a wall in said main body, a vibratory member in said oil pressure chamber, said vibratory member being positioned for bringing them into self-excited oscillation by flow of pressurized oil through said oil inflow port and said flow ports, and a pair of resiliently disposed stopper means positioned for regulating the excursion of said vibrating member in each of opposed directions by impact of said vibrating member against said stopper means, both of said stopper means including first and second stoppers adapted to be positionally displaced with respect to each other, and first and second resilient biasing means for respectively resiliently positioning said first and second stopper with respect to said oil pressure chamber, said oil pressure chamber having two opposed ends and having axially aligned bearings proximate both of said ends, said vibratory member being a spool supported slidably inside said oil pressure chamber by said bearings, and being maintained at a predetermined spacing from said wall of said oil pressure chamber, said spool having a first land at a position opposed to said inflow port and being in minus-lap relationship thereto, said first land dividing said chamber into two pockets, said main body having a pair of second ports positioned for connection with each of said pockets, said spool having a pair of second lands for closing and opening each of said pair of second ports alternately during oscillation of said spool, the relation of said first land to said inflow port being such that pressurized oil flows alternately into each of said pockets during oscillation of said vibratory member and out through the corresponding port of said first pair of ports, while oil in the pocket other than that containing pressurized oil can flow out of same through the other corresponding port of said pair of second ports said first land and said pair of second lands being of the same diameter.

2. The hydraulic oscillator as defined in claim 1 wherein said oil inflow port is in the form of a single annular groove having walls which diverge in the direction of oil flow into said chamber to provide a force of restoration to said spool as said oil enters one or the other of said pockets alternately.

3. The hydraulic oscillator as defined in claim 1, wherein said resilient biasing means are springs.

4. The hydraulic oscillator as defined in claim 1, further comprising a chamber between said spool and each of said first stoppers, and wherein each of said second stoppers is a piston movable along the direction of motion of said vibratory member, and said main body including a pair of passages for introducing pressurized oil against said respective pistons for moving same separately in a direction away from the corresponding end of said chamber.

5. The hydraulic oscillator as defined in claim 1, wherein the hydraulic oscillator further comprises a regulating valve for controlling the flow of pressurized oil to said inflow port of said main body for controlling the output of pressurized oil from said hydraulic oscillator.

* * * * *